US007311542B2

(12) United States Patent
Suzuki

(10) Patent No.: US 7,311,542 B2
(45) Date of Patent: Dec. 25, 2007

(54) CONNECTOR

(75) Inventor: Masayuki Suzuki, Koto-ku (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 11/623,539

(22) Filed: Jan. 16, 2007

(65) Prior Publication Data

US 2007/0111602 A1 May 17, 2007

Related U.S. Application Data

(63) Continuation of application No. PCT/JP2005/013789, filed on Jul. 21, 2005.

(30) Foreign Application Priority Data

Aug. 10, 2004 (JP) ..... 2004-233197

(51) Int. Cl.
*H01R 13/15* (2006.01)

(52) U.S. Cl. ..... 439/260; 439/495

(58) Field of Classification Search ..... 439/260, 439/495

See application file for complete search history.

(56) References Cited

U.S. PATENT DOCUMENTS

| | | | | |
|---|---|---|---|---|
| 4,808,113 | A | 2/1989 | Kanesige et al. | |
| 5,906,498 | A * | 5/1999 | Nagafuji | 439/260 |
| 5,928,029 | A | 7/1999 | Lam | |
| 6,056,572 | A | 5/2000 | Matsumoto et al. | |
| 6,338,648 | B1 | 1/2002 | Miura et al. | |
| 6,471,541 | B2 | 10/2002 | Kunishi et al. | |
| 6,726,497 | B2 * | 4/2004 | Nogawa et al. | 439/260 |
| 6,755,682 | B2 | 6/2004 | Kunishi et al. | |
| 6,855,002 | B2 * | 2/2005 | Chiu | 439/495 |

FOREIGN PATENT DOCUMENTS

| | | |
|---|---|---|
| JP | 60-57083 U | 4/1985 |
| JP | 03-8886 U | 1/1991 |
| JP | 03-103578 U | 10/1991 |
| JP | 06-176826 | 6/1994 |
| JP | 06-86289 U | 12/1994 |
| JP | 09-199241 | 7/1997 |
| JP | 10-208810 | 9/1998 |
| JP | 11-031561 | 2/1999 |
| JP | 11-307198 | 11/1999 |
| JP | 2000-106238 | 4/2000 |
| JP | 2000-299168 | 10/2000 |
| JP | 2001-076794 | 3/2001 |
| JP | 2002-093526 | 3/2002 |
| JP | 2002-270290 | 9/2002 |
| JP | 2002-270920 | 9/2002 |
| JP | 2002-280100 | 9/2002 |
| JP | 2003-151662 | 5/2003 |
| JP | 2004-071160 | 3/2004 |
| JP | 2004-221067 | 8/2004 |

* cited by examiner

*Primary Examiner*—Briggitte R. Hammond
(74) *Attorney, Agent, or Firm*—Baker Botts L.L.P.

(57) ABSTRACT

A connector includes a plurality of contacts each including a first piece having a contact portion, a pressure receiving portion, and a projection inwardly extending from the pressure receiving portion; a second piece having a connection portion and a fulcrum portion; and an elastic portion for connecting the first piece and the fulcrum portion. The contact portion, elastic portion, fulcrum portion and connection portion are arranged in the form of a crank. A housing is formed with protection walls for preventing its ceiling portion from being raised. The pivoting member is mounted on the housing so that the axis of rotation is moved with its pivotal movement to achieve their compact rotation. With the construction, the connector achieves a miniaturization or reduced overall height, and a stable electrical connection with simple operation and slight operating force without any failed connection even if being subjected to undue external force.

18 Claims, 15 Drawing Sheets

CONNECTOR

CROSS-REFERENCE TO RELATED APPLICATIONS

This application is a continuation of International Application No. PCT/JP2005/013789, filed Jul. 21, 2005, which claims priority to Japanese Patent Application No. 2004-233,197, filed Aug. 10, 2004, both of which are incorporated by reference in their entirety herein and from which priority is claimed.

TECHNICAL FIELD

The present invention relates to a connector for use in mobile phones or cellular phones, notebook personal computers, digital cameras or the like, and more particularly to a connector superior in stable electrical connection to a connecting object such as a flexible printed circuit board or flexible flat cable.

BACKGROUND ART

In general, connectors for use in mobile phones, charge coupled device (CCD) cameras and the like are much thinner and having contacts arranged in extremely narrow pitches (so-called lighter and more compact connectors). These connectors each mainly comprise a housing, contacts and a slider to embrace a flexible printed circuit board or flexible flat cable between the housing and the slider. To embrace the flexible printed circuit board or flexible flat cable by the housing and the slider, various methods may be considered, and there have been used constructions in many cases that after a flexible printed circuit board or flexible flat cable has been inserted into the housing, the slider is inserted into the housing to press the board or cable against the contacts.

The housing is provided with a required number of inserting holes for inserting the contacts and also a fitting opening for inserting a flexible printed circuit board or flexible flat cable.

As shown in FIGS. 12A and 12B, each of the contacts 64 is substantially U-shaped and mainly comprises a contact portion 22 adapted to contact the circuit board or flat cable, a connection portion 24 to be connected to a circuit board or the like, and a fixed portion 42 to be fixed to the housing 62. The contacts 64 are fixed to the housing 62 by press-fitting or the like.

For example, the slider 66 is substantially in the form of a wedge as shown in FIGS. 12A and 12B. The slider 66 is inserted into the housing 62 after the flexible printed circuit board 40 or flexible flat cable has been inserted into the housing 62 with the required number of contact 64 installed. Such a slider 66 mainly comprises a mounting portion 74 to be mounted in the housing 62 and an urging portion 68 for urging the circuit board 40 or flat cable against the contact portions 22 of the contacts 64. The slider 66 is temporarily inserted into the housing 62, prior to the insertion of the circuit board or flat cable. After the insertion of the circuit board or flat cable, the slider 66 is inserted into the housing 62 again so that the urging portion 68 of the slider 66 is positioned in parallel with the circuit board 40 or flat cable to cause the circuit board or flat cable to be urged against the contact portions 22 of the contacts 64.

Other than these, there have been constructions for bringing contacts into contact with a connecting object such as a flexible printed circuit board or the like by the use of a pivoting member or the like as disclosed in the following patent literatures.

"Patent Literature 1"

According to the Abstract of Japanese Patent Application Opened No. 2002-270,290, this invention has an object to provide a connector of lower geometry or miniaturization in height including an actuator to be operated by a slight actuating force and enabling contacts to move large distances to perform reliable connection of the contacts. The actuator includes cam portions and an actuating portion and is formed between the cam portions and the actuating portion with relief grooves into and from which the forward ends of spring portions of the contacts are inserted and removed for the purpose of obtaining a further lower geometry connector. When the actuator is rotated clockwise about its fulcrum point through 90 degrees, the cam portions cause the spring portions and connection spring portions to be elastically deformed, thereby embracing the flexible circuit board between projections of the contact portions of the contacts to achieve electrical connection between patterns of the circuit board and a printed board through terminals of the contacts. A ceiling portion of an insulator or housing covers the contact portions of the contacts, and the lower portion below the ceiling portion on the front side is formed with a guide for inserting the circuit board into the connector. By the way, the claim 1 of the Japanese Patent Application Opened No. 2002-270,290 recites that in a connector including contacts, an insulator for holding the contacts, and an actuator rotatably mounted on the insulator and causing the contacts to be elastically deformed to bring them into contact with a connecting object, the contacts each consist of a first beam having a contact portion at its one end adapted to contact the connecting object and an actuated portion at the other end adapted to be actuated by the actuator, a second beam having a contact portion at its one end adapted to contact the connecting object and a terminal at the other end to be connected to a printed substrate, and a connecting spring for connecting the first and second beams, and said insulator has a ceiling portion for covering at least the contact portions of the contacts on the fitting side and said ceiling portion formed with a guide for guiding the insertion of the connecting object. Claim 2 recites a connector of the contacts each of which has at least one contact portion having in the proximity of the connecting spring an inclined portion inclining toward the connecting object. Claim 3 recites a connector of the actuator having an actuating portion, cam portions for actuating the actuated portions of the contacts, and relief groves positioned between the actuating portion and the cam portions so that in the state that the connecting object is not connected to the connector, the actuated portions can be inserted into the relief grooves. Claim 4 recites that in a connector including contacts, an insulator holding the contacts and an actuator rotatably mounted on the insulator and causing the contacts to be elastically deformed to bring them into contact with a connecting object, said contacts each consist of a first beam having a contact portion at its one end adapted to contact the connecting object and an actuated portion at the other end adapted to be actuated by the actuator, a second beam having a contact portion at its one end adapted to contact the connecting object and a terminal at the other end to be connected to a printed substrate, and a connecting spring for connecting the first and second beams, said contact portion of the first beam having a first projection and a second projection extending toward the connecting object and arranged side by side in the inserting direction of the connecting object, and said contact portion of the second beam having a third projection and a fourth projection extending toward the connecting object and arranged side by side in the inserting direction of the connecting object, so that depending upon the third projection being positioned between the first and second projections or the first projection being positioned between the third and fourth projections, the first and second projections or the third and fourth projections come into contact with the connecting object.

"Patent Literature 2"

According to the Abstract of Japanese Patent Application Opened No. H11-31,561/1999, this invention has an object to provide a connector superior in operationality and capable of reliably connecting flat wires. When a pivoting member provided at an opening on the opposite side of an inserting opening for flat wires is at the starting position of the pivotal movement, the press-connecting portions of the pivoting member do not abut against peripheries of corners of contact elements, and the connector is under the opened condition in which flat wires are freely inserted or removed. By pivotally moving the pivoting member the press-connecting portions of the pivoting member press the peripheries of corners of the contact elements to cause elastic deformation so that the contact portions are forced to connect the flat wires. At the terminal position of the pivotal movement, the press-connecting portions of the pivoting member ride over the apexes of the corners of the contact elements to cause forces in directions to maintain the connection state by elastic restoring force of the contact elements. By the way, claim 1 of the Japanese Patent Application Opened No. H11-31,561/1999 recites a connector comprising a housing having an inserting opening for flat wires and an opening on the opposite side thereof, a plurality of contact elements installed in the interior of the housing, and a pivoting member rotatably supported on the housing on the opening side, said pivoting member having press-connecting portions which are not pressed to the contact elements to allow the flat wires to be inserted and removed into and from the inserting opening of the housing at the starting position of the pivoting member, while the press-connecting portions are pressed against the contact elements to cause the contact elements to be elastically deformed so that the contact portions of the contact elements are brought into close contact with the flat wires at the terminal position of the pivoting member. Claim 2 recites a connector of the pivoting member whose press-connecting portions are caused to be pressed against peripheries of corners of the contact elements, and whose press-connecting portions are on one side of a line connecting the center of pivotal movement and apexes of the corners at the starting position of the pivotal movement, on progressing of the pivotal movement the press-connecting portions are moving over the line, and the press-connecting portions are on the other side of the line at the terminal position of the pivotal movement. Claim 3 recites a connector of the pivoting member whose press-connecting portions are pressed against peripheries of the corners on one ends of the contact elements so that the contact portions on the other ends of the contact elements are brought into close contact with the inserted flat wires. Claim 4 recites a connector of contact elements each having a pair of contact portions opposed to each other, and the press-connecting portions of the pivoting member are pressed against the contact elements at the terminal position of the pivoting member so that one of each pair of contact portions is elastically deformed onto the other side to embrace the inserted flat wires by both the contact portions.

"Patent Literature 3"

According to the Abstract of Japanese Patent Application Opened No. H11-307,198/1999, this invention has an object to provide a connector connected to a plurality of terminals and holding a flexible printed circuit board superior in operationality and holding power. The disclosed connector for a printed circuit board includes a housing formed with inserting groove for inserting the flexible printed circuit board, a plurality of contacts provided side by side whose contact portions are arranged to extend and retract relative to the inserting groove, and an actuating member arranged pivotally movably between a connecting and a disconnecting position. The actuating member is provided with a plurality of cams so that when the actuating member is in the connecting position, contacts are urged with their actuated portions by the cams to extend their contact portions into the inserting groove thereby enabling the contact portions to be pressed and connected to terminals of the flexible printed circuit board and holding the circuit board. While when the actuating member is in the disconnecting position, some contacts are urged with their actuated portions by the cams to slightly extend their contact portions into the inserting groove so as to abut against the flexible printed circuit board, thereby temporarily holding the circuit board, while the contact portions of the remaining contacts are retracted from the inserting groove. By the way, claim 1 of the Patent Literature 3 recites that in a connector for a printed circuit board, the connector provided with a plurality of contacts arranged side by side for connecting a plurality of terminals of a printed circuit board or the like in the lump, comprises a housing having an inserting groove for inserting the printed circuit board or the like, said contacts arranged to extend and retract relative to said inserting groove, and an actuating member provided movably between a connecting and a disconnecting position, and when the actuating member is in the connecting position, the contacts are urged by the actuating member so as to extend into the inserting groove to press the terminals of the flexible printed circuit board or the like so that the contacts are connected to the terminals and hold the printed circuit board or the like, and when the actuating member is in the disconnecting position, the some of the contacts extend slightly into the inserting groove to abut against and temporarily hold the printed circuit board or the like, and the remaining contacts retract relative to the inserting groove. Claim 2 recites a connector for a printed circuit board in that the plurality of the contacts are formed in the same shape and the actuating member is provided with a plurality of cams, and when the actuating member is in the connecting position, the contacts are urged by the cams to extend into the inserting groove, and when the actuating member is in the disconnecting position, the some contacts are urged by the cams to slightly extend into the inserting groove and the remaining contacts are retracted relative to the inserting groove.

"Patent Literature 4 "

Japanese Patent Application Opened No. 2004-71,160 discloses a connector capable of securely urging a flexible printed circuit board or flexible flat cable to contact portions of contacts with the aid of a slider without degrading strength of respective members and specifications or customers demands, and capable of being used with high operationality and fully complying with requirements such as narrower pitches of conductors and lower geometry or miniaturization in height. This connector comprises contacts each comprising a contact portion, a connection portion, and an elastic portion and a fulcrum portion between the contact portion and the connection portion, and a pressure receiving portion extending from the elastic portion in a position opposite to the connection portion, and the contact portion, elastic portion, fulcrum portion and connection portion being arranged in the form of a crank, and a slider comprising urging portions arranged continuously in the longitudinal direction and pivotally mounted on a housing so that the urging portions are pivotally moved in a space between the connection portions and pressure receiving portions of the contacts. Claim 1 of the Patent Literature 4 recites a connector removably fitted with a flexible printed circuit board or flexible flat cable, including a required number of contacts having a contact portion adapted to contact said flexible printed circuit board or flexible flat cable, a housing holding and fixing the contacts and having an inserting opening for inserting the flexible printed circuit board or flexible flat cable, and a slider for urging the flexible printed circuit board or flexible flat cable to the contacts, wherein the contacts each comprise an elastic portion and a fulcrum portion between the contact portion and a connection portion, and a pressure receiving portion extending from the elastic portion and located in a position opposite to the connection portion, and the connection portion, elastic portion, fulcrum portion and connection portion being arranged substantially in the form of a crank, and the slider is provided with urging portions continuously arranged in its longitudinal direction and is mounted on the housing so that the urging portions are pivotally moved in a space between the connection portions and pressure receiving portions of the contacts. Claim 2 recites a connector removably fitted with a flexible printed circuit board or flexible flat cable, including a required number of contacts having a contact portion adapted to contact said flexible printed circuit board or flexible flat cable, a housing holding and fixing the contacts and having an inserting opening for inserting the flexible printed circuit board or flexible flat cable, and a slider for urging the flexible printed circuit board or flexible flat cable to the contacts, wherein two kinds of contacts are arranged alternately staggered, the contacts of one kind each comprising an elastic portion and a fulcrum portion between the contact portion and a connection portion, and a pressure receiving portion extending from the elastic portion in a position opposite to the connection portion, and the contact portion, elastic portion, fulcrum portion and connection portion being arranged substantially in the form of a crank, and the contacts of the other kind each comprising an elastic portion and a fulcrum portion between the contact portion and a connection portion, and a pressure receiving portion extending in the opposite direction of the contact portion, and the contact portion, elastic portion, fulcrum portion, and connection portion being arranged substantially in the form of a U-shape, and the slider is provided with urging portions arranged continuously in its longitudinal direction and mounted on the housing so that the urging portions are pivotally moved in a space between the connection portions and the pressure receiving portions of the contacts of the one kind and between the pressure receiving portions and the housing of the contacts of the other kind. Claim 3 recites that when the urging portions of the slider are pivotally moved in the space between the connection portions and the pressure receiving portions of the contacts of the one kind, the pressure receiving portions are raised by the urging portions so that the elastic portions are tilted about the fulcrum portions toward the contact portions to urge the contact portions against the flexible printed circuit board or flexible flat cable. Claim 4 recites that the pressure receiving portions of the contacts of the one kind or the other kind are each provided with a projection so that the urging portions of the slider are prevented from moving toward the connection portions of the contacts of the one kind. Claim 5 recites that the urging portions of the slider are of an elongated shape. Claim 6 recites that the slider is formed with a required number of anchoring grooves independent from one another, which are adapted to engage the projections of the contacts, respectively. Claim 7 recites the elongated urging portions being in the form of an ellipsoid. Claim 8 recites a connector of contacts each provided with a further contact portion at a location extending from the fulcrum portion and adapted to contact the flexible printed circuit board or flexible flat cable. Claim 9 recites that the contacts of the other kind are each provided with an extension portion extending from the fulcrum in the opposite direction of the connection portion, and the slider is mounted on the housing so that the urging portions of the slider are pivotally moved in the space between the extension portions and the pressure receiving portions. Claim 10 recites a connector of the contacts of the other kind each provided between the fulcrum portion and the connection portion with a contact portion adapted to contact the flexible printed circuit board or flexible flat cable.

In recent years, with miniaturization of electrical and electronic appliances, the connectors 60 of this kinds have been strongly required to be more miniaturized, particularly to have a flat geometry or reduced overall height. In the connector 60 of the prior art described above, there are six layers in height as shown in FIG. 12B (that is, the upper and lower walls of the housing 62, the contact portion 22 and the receiving portion 70 of each of the contacts 64, the urging portion 68 of the slider 66 and the flexible printed circuit board 40 or flexible flat cable). In order to reduce the connector's height as much as possible, it is possible to remove the receiving portion 70 of each of the contacts 64 to obtain five layers in height (that is, the upper and lower walls of the housing 62, the contact portion 22 of each of the contacts 64, the urging portion 68 of the slider 66 and the flexible printed circuit board 40 or flexible flat cable). However, it is impossible to more reduce the height of the connector in consideration of strength of the respective members and specifications or customer's demands. With the connector 60 described above, moreover, the insertion of the circuit board 40 or flat cable, and urging of the contact portions 22 of the contacts 64 against the circuit board 40 or flat cable take place only on the side of the fitting opening of the housing 62, so that as the connector is miniaturized, such operations would become more difficult. In the case that extremely narrow pitches of contacts of the connector 60 are required, moreover, the insertion of contacts into the connector from only one side would prevent or impede the required miniaturization of the connector.

Under such circumstances, the connectors of a so-called "back-lock type" as in the Patent Literatures 1 to 4 have been proposed, wherein the pivoting member is operated on the opposite side of the fitting opening into which a connecting object such as a flexible printed circuit board is inserted, thereby causing the contacts to be elastically deformed to bring the contact portions of the contacts into contact with the connecting object.

With the construction disclosed in the Patent Literature 1, as the cam portions of the actuator are rotated about one point as a fulcrum, the cam portions could not perform a compact rotation, and the connector could not achieve more miniaturization in height and could not prevent the permanent set in fatigue of springs and undue increase in locking force. Moreover, applied torque in the clockwise direction could not be certainly stopped or a location at which application of torque should be ended is not clear.

With the construction disclosed in the Patent Literature 2, the miniaturization in height could not be achieved, and a large operating force to be applied to the actuator is required to obtain a desired contact force between the contacts and board or cable so that reliability of contact would be poor.

Moreover, as the actuator is rotated about one point of fulcrum, a compact rotation could not be obtained, and the permanent set in fatigue of springs and undue increase in locking force could not be prevented and applied annular moment or torque could not be certainly stopped.

Similarly to the Patent Literature 1, even with the construction disclosed in the Patent Literature 3, as the pivoting member is rotated about one point of the pivotal axis X, the compact rotation could not be obtained and more miniaturization in height could not be achieved. Moreover, the permanent set in fatigue of the springs and undue increase in locking force could not be prevented, and applied annular moment or torque could not be certainly stopped.

With the construction of the Patent Literature 4 (FIGS. 2 and 6 thereof), as the fitting opening into which the connecting object such as a flexible printed circuit board or the like is inserted is chamfered, when the connecting object is accidentally subjected to an external force in an upward direction, the housing would be likely to be raised so that the contacts also would be raised to make it impossible to obtain stable contacting force (particularly, in the case of contacts positioned on bottom side), resulting into defective or failed connection. This problem would be particularly acute when a connector is miniaturized, particularly with reduced overall height and accidentally subjected to undue external forces in the case of rotating an actuator or pivoting member on the opposite side of the fitting opening. Concerning this tendency, the same holds true in the connectors disclosed in the Patent Literatures 1 to 3.

In the case of the Patent Literatures 1 to 3, moreover, the contact portions of the contacts provided on the upper side and further the front ends or entire portions of the contacts on the opposite side thereof are held by an insulator or housing, so that the miniaturization in height of the connectors would be limited or impeded.

SUMMARY OF THE INVENTION

It is an object of the invention to provide a connector which, in view of the problems of the prior art, can achieve the miniaturization of the connector, narrower pitches and lower geometry or reduced overall height and can obtain stable connection with simple operation and slight operating force without any defective or failed connection, even if a connecting object such as a flexible printed circuit board fitted in the connector is accidentally subjected to undue external forces.

The above object can be achieved by the connector 10 according to the invention including a plurality of contacts 14 having at least one contact portion 22 adapted to contact a connecting object, a housing 12 arranging and holding the contacts 14 and having a fitting opening 18 into which the connecting object is inserted, and a pivoting member 16 for causing the contacts 14 to be elastically deformed to urge the contacts against the connecting object, wherein the contacts 14 each comprise a first piece having the contact portion 22 at one end adapted to contact the connecting object, a pressure receiving portion 20 at the other end adapted to be urged by the pivoting member 16, and a projection 26 inwardly extending from the front end of the pressure receiving portion 20; a second piece having a fulcrum portion 32 at one end, and a connection portion 24 at the other end adapted to be connected to a board; and an elastic portion 34 for connecting the first piece and the fulcrum portion 32; and the contact portion 22, the elastic portion 34, the fulcrum portion 32 and the connection portion 24 being arranged substantially in the form of a crank, wherein the housing 12 includes a ceiling portion for covering the contact portions 22 of the contacts 14, the ceiling portion being formed at least on both the ends with protection walls 17 for preventing the ceiling portion from being raised when the connecting object is accidentally subjected to undue external force, and wherein the pivoting member 16 includes an actuating portion for pivotally moving the pivoting member, urging portions 36 continuously arranged in the longitudinal direction of the pivoting member, and anchoring grooves 30 independent from one another for receiving therein the pressure receiving portions 36 and adapted to engage the projections 26, respectively, and the pivoting member 16 is mounted on the housing 12 so that the urging portions 36 are pivotally moved between the connection portions 24 and the pressure receiving portions 20 of the contacts 14, and the rotational axis 50 of the urging portions is moved with their pivotal movement to achieve their compact rotation.

Even narrower pitches of conductors in the object of the invention can be accomplished by the connector 101 according to the invention including a plurality of contacts 14 having at least one contact portion 22 adapted to contact a connecting object, a housing 121 arranging and holding the contacts 14 and having a fitting opening 18 into which the connecting object is inserted, and a pivoting member 161 for causing the contacts 14 to be elastically deformed to urge the contacts against the connecting object, wherein the contacts consist of two kinds of contacts 14, 141 arranged alternately staggered, the contacts 14 of the one kind each comprising a first piece having the contact portion 22 at one end adapted to contact the connecting object and a pressure receiving portion 20 at the other end adapted to be urged by the pivoting member 16; a second piece having a fulcrum portion 32 at one end and a connection portion 24 at the other end adapted to be connected to a board; and an elastic portion 34 for connecting the first piece and the fulcrum portion 32; and the contact portion 22, the elastic portion 34, the fulcrum portion 32 and the connection portion 24 being arranged substantially in the form of a crank, and the contacts 141 of the other kind each comprising a first piece having the contact portion 22 at one end adapted to contact the connecting object and a pressure receiving portion 20 at the other end adapted to be urged by the pivoting member 16; a second piece having a connection portion 24 at one end adapted to be connected to a board and a fulcrum portion 32 at the other end; and an elastic portion 34 for connecting the first piece and the fulcrum portion 32; and the contact portion 22, the elastic portion 34, the fulcrum portion 32 and the connection portion 24 being arranged substantially in the form of a U-shape, and the pressure receiving portions 20 of the contacts of at least either the one kind or the other kind being each provided at the front end with an inwardly extending projection 26, wherein the housing 121 includes a ceiling portion for covering the contact portions 22 of the contacts 14, 141, the ceiling portion being formed at least on both the ends with protection walls 17 for preventing the ceiling portion from being raised when the connecting object is accidentally subjected to undue external force, and wherein the pivoting member 161 includes an actuating portion for pivotally moving the pivoting member, urging portions 36 continuously arranged in the longitudinal direction of the pivoting member, and anchoring grooves 30 independent from one another for receiving therein the pressure receiving portions 20 and adapted to engage the projections 26, respectively, and the pivoting member is mounted on the housing 121 so that the urging portions 36 are pivotally moved between the connection portions 24 and the pressure receiving portions 20 of the contacts 14 of the one kind and between the pressure receiving portions 20 of the contacts 141 of the other kind and the housing 121, and the rotational axis 50 of the urging portions is moved with their pivotal movement to achieve their compact rotation.

When the connecting object is connected to the connector 10, 101, the urging portions 36 of the pivoting member are positioned such that before connecting the connecting object to the connector 10, 101, the lower ends 54 of the urging portions 36 are positioned between the projections 26 of the pressure receiving portions 20 and the connection portions 24 and the housing 12, 121 or extension portions 44, that second on pivotally moving the actuating portion of the pivoting member, the urging portions 36 are moved in a direction opposite to the fitting opening 18 so that the lower ends 54 of the urging portions are embraced between the projections 26 of the pressure receiving portions 20 and the connection portions 24 and the housing 12, 121 or extension portions 44, that third on further pivotally moving the actuating portion of the pivoting member, the urging portions 36 at their second position are pivotally moved about the center of the urging portions 36 as their rotational axis 50, that fourth on further pivotally moving the actuating portion of the pivoting member, the urging portions 36 at their third position are pivotally moved about the center of the urging portions 36 as their rotational axis 50 so that the urging portions 36 stand substantially upright between the pressure receiving portions 20 and the connection portions 24 and the housing 12, 121 or the extension portions 44, and the rotational axis 50 is moved toward the upper ends 52 of the urging portions in contact with the projections 26, and that finally on further pivotally moving the actuating portion of the pivoting member, the urging portions 36 at their fourth position are pivotally moved about a center in the proximity of the upper ends 52 of the urging portions in contact with the projections 26 to cause the urging portions 36 to engage the projections 26.

The ceiling portion is further provided with a protection wall 17 substantially at its center for preventing the ceiling portion from being raised when the connecting object is accidentally subjected to undue external force. The contacts 14 and the contacts 14 of the one kind are each provided with an extension portion 44 extending from the fulcrum portion 32 in such a direction that the extension portion faces to the contact portion 22.

Moreover, the contacts 141 of the other kind are each provided with an extension portion 44 extending from the fulcrum portion 32 in such a direction that the extension portion faces to the pressure receiving portion 20, and the pivoting member 161 is mounted on the housing 121 so that the urging portions 36 of the pivoting member 161 are pivotally moved between the extension portions 44 and the pressure receiving portions 20.

A further contact portion 22 adapted to contact the connecting object is provided on the extension portion 44 of each of the contacts 14 and the contacts of the one kind 14, and a further contact portion 22 adapted to contact the connecting object is also provided between the fulcrum portion 32 and the connection portion 24 of each of the contacts 141 of the other kind.

The housing 121 is provided with recessed portions 19 on the side of the fitting opening 18 for conducting a connecting object, and the contacts 141 of the other kind are so arranged that the connection portions 24 of the contacts 141 do not extend from the recessed portions 19.

The connecting object is provided with anchoring portions, and there are provided locking members each having an engaging portion adapted to engage the anchoring portion and the locking means are substantially the same in construction as that of the contacts 14, the contacts 14 of the one kind or the contacts 141 of the other kind.

The further contact portion 24 provided on the extension portion 44 of each of the contacts 14 and the contacts 14 of the one kind is constructed to have elasticity, and the further contact portion 24 provided between the fulcrum portion 32 and the connection portion 24 of each of the contacts 141 of the other kind is constructed to have elasticity.

Moreover, the housing 12, 121 is provided with anchoring portions 48 at locations corresponding to the connection portions 24 of the contacts 14 or the contacts 14 of the one kind, while the connection portions 24 of the contacts 14 and the contacts 14 of the one kind are each provided with an inclined engaging portion 46 adapted to engage the anchoring portion 48, and the extension portions 44 of the contacts 14 and the contacts 14 of the one kind are not held by the housing 12, 121.

In inserting the contact 14 or the contact 14 of the one kind into the housing 12, 121 from the opposite side of the fitting opening 18, at the commencement of the engagement of the anchoring portion 48 with the engaging portion 46, the contact portion 22 of the contact 14 is substantially in parallel with an inserting hole 38 of the housing 12, 121, and on proceeding of the insertion the contact 14 is obliquely inclined so that the contact portion 22 of the contact comes into contact with the upper wall of the inserting hole 38, and when the insertion of the contact has been completed, the contact portion 22 has returned in parallel with the inserting hole 38 with the aid of the inclined engaging portion 46.

The further contact portion 22 provided on the extension portion 44 of each of the contacts 14 and the contacts 14 of the one kind and the further contact portion 22 provided between the fulcrum portion 32 and the connection portion 24 of each of the contacts 141 of the other kind are of a bent shape to extend into the fitting opening 18 and have elasticity.

Moreover, a tip of each of the further contact portions 22 is provided with a protrusion.

In the case that the connecting object such as a flexible printed circuit board 40 or the like is inserted into the connector 10 or 101 described in claim 1 or 2, the connecting object may be conducted into the fitting opening 18 of the housing 12 of the connector in a manner putting or applying it onto the lower surface of the fitting opening or the connection portions 24 of the contacts 141 of the other kind.

The connector 10, 101 achieves the following function. After a connecting object such as the flexible printed circuit board or flexible flat cable has been inserted into the fitting opening 18 of the housing 12, 121, the urging portions 36 of the pivoting member 16, 161 are pivotally moved in a space between the connection portions 24 and the pressure receiving portions 20 of the contacts 14 of the one kind and between the pressure receiving portions 20 and the extension portions 44 of the contacts 141 of the other kind, so that the pressure receiving portions 20 are raised by the urging portions 36 to cause the elastic portions 34 of both the contacts 14 and 141 to be tilted about the fulcrums 32 toward the contact portions 22, thereby urging the contact portions 22 against the connecting object such as the flexible printed circuit board 40 or flexible flat cable.

As can be seen from the above description, the connector according to the invention can bring about the following significant effects.

(1) The connector 10 according to the invention includes a plurality of contacts 14 having at least one contact portion 22 adapted to contact a connecting object, a housing 12 arranging and holding the contacts 14 and having a fitting opening 18 into which the connecting object is inserted, and a pivoting member 16 for causing the contacts 14 to be elastically deformed to urge the contacts against the connecting object, wherein the contacts 14 each comprise a first piece having the contact portion 22 at one end adapted to contact the connecting object, a pressure receiving portion 20 at the other end adapted to be urged by the pivoting member 16, and a projection 26 inwardly extending from the front end of the pressure receiving portion 20; a second piece having a fulcrum portion 32 at one end, and a connection portion 24 at the other end adapted to be connected to a board; and an elastic portion 34 for connecting the first piece and the fulcrum portion 32; and the contact portion 22, the elastic portion 34, the fulcrum portion 32 and the connection portion 24 being arranged substantially in the form of a crank, wherein the housing 12 includes a ceiling portion for covering the contact portions 22 of the contacts 14, the ceiling portion being formed at least on both the ends with protection walls 17 for preventing the ceiling portion from being raised when the connecting object is accidentally subjected to undue external force, and wherein the pivoting member 16 includes an actuating portion for pivotally moving the pivoting member, urging portions 36 continuously arranged in the longitudinal direction of the pivoting member, and anchoring grooves 30 independent from one another for receiving therein the pressure receiving portions 36 and adapted to engage the projections 26, respectively, and the pivoting member 16 is mounted on the housing 12 so that the urging portions 36 are pivotally moved between the connection portions 24 and the pressure receiving portions 20 of the contacts 14, and the rotational axis 50 of the urging portions is moved with their pivotal movement to achieve their compact rotation. Therefore, the miniaturization, lower geometry or reduced overall height and narrower pitches of the connector 10 can be achieved, and stable connection can be obtained with simple operation and slight operating force. As the axis of rotation of the urging portions of the pivoting member moves with its pivotal movement, compact rotation can be obtained without any permanent set in fatigue of springs and without any undue increase in locking force. Even if the connecting object is accidentally subjected to undue external force, defective or failed connection can be avoided.

(2) The connector 101 according to the invention includes a plurality of contacts 14 having at least one contact portion 22 adapted to contact a connecting object, a housing 121 arranging and holding the contacts 14 and having a fitting opening 18 into which the connecting object is inserted, and a pivoting member 161 for causing the contacts 14 to be elastically deformed to urge the contacts against the connecting object, wherein the contacts consist of two kinds of contacts 14, 141 arranged alternately staggered, the contacts 14 of the one kind each comprising a first piece having the contact portion 22 at one end adapted to contact the connecting object and a pressure receiving portion 20 at the other end adapted to be urged by the pivoting member 16; a second piece having a fulcrum portion 32 at one end and a connection portion 24 at the other end adapted to be connected to a board; and an elastic portion 34 for connecting the first piece and the fulcrum portion 32; and the contact portion 22, the elastic portion 34, the fulcrum portion 32 and the connection portion 24 being arranged substantially in the form of a crank, and the contacts 141 of the other kind each comprising a first piece having the contact portion 22 at one end adapted to contact the connecting object and a pressure receiving portion 20 at the other end adapted to be urged by the pivoting member 16; a second piece having a connection portion 24 at one end adapted to be connected to a board and a fulcrum portion 32 at the other end; and an elastic portion 34 for connecting the first piece and the fulcrum portion 32; and the contact portion 22, the elastic portion 34, the fulcrum portion 32 and the connection portion 24 being arranged substantially in the form of a U-shape, and the pressure receiving portions 20 of the contacts of at least either the one kind or the other kind being each provided at the front end with an inwardly extending projection 26, wherein the housing 121 includes a ceiling portion for covering the contact portions 22 of the contacts 14, 141, the ceiling portion being formed at least on both the ends with protection walls 17 for preventing the ceiling portion from being raised when the connecting object is accidentally subjected to undue external force, and wherein the pivoting member 161 includes an actuating portion for pivotally moving the pivoting member, urging portions 36 continuously arranged in the longitudinal direction of the pivoting member, and anchoring grooves 30 independent from one another for receiving therein the pressure receiving portions 20 and adapted to engage the projections 26, respectively, and the pivoting member is mounted on the housing 121 so that the urging portions 36 are pivotally moved between the connection portions 24 and the pressure receiving portions 20 of the contacts 14 of the one kind and between the pressure receiving portions 20 of the contacts 141 of the other kind and the housing 121, and the rotational axis 50 of the urging portions is moved with their pivotal movement to achieve their compact rotation. Accordingly, the miniaturization, lower geometry or reduced overall height and narrower pitches of the connector 101 can be achieved, and stable connection can be obtained with simple operation and slight operating force. As the axis of rotation of the urging portions of the pivoting member moves with its pivotal movement, compact rotation can be obtained without any permanent set in fatigue of springs and without any undue increase in locking force. Even if the connecting object is accidentally subjected to undue external force, defective or failed connection can be avoided.

(3) According to the invention when the connecting object is connected to the connector 10, 101, the urging portions 36 of the pivoting member are positioned such that before connecting the connecting object to the connector 10, 101, the lower ends 54 of the urging portions 36 are positioned between the projections 26 of the pressure receiving portions 20 and the connection portions 24 and the housing 12, 121 or extension portions 44, that second on pivotally moving the actuating portion of the pivoting member, the urging portions 36 are moved in a direction opposite to the fitting opening 18 so that the lower ends 54 of the urging portions are embraced between the projections 26 of the pressure receiving portions 20 and the connection portions 24 and the housing 12, 121 or extension portions 44, that third on further pivotally moving the actuating portion of the pivoting member, the urging portions 36 at their second position are pivotally moved about the center of the urging portions 36 as their rotational axis 50, that fourth on further pivotally moving the actuating portion of the pivoting member, the urging portions 36 at their third position are pivotally moved about the center of the urging portions 36 as their rotational axis 50 so that the urging portions 36 stand substantially upright between the pressure receiving portions 20 and the connection portions 24 and the housing 12, 121 or the extension portions 44, and the rotational axis 50 is moved toward the upper ends 52 of the urging portions in contact with the projections 26, and that finally on further pivotally moving the actuating portion of the pivoting member, the urging portions 36 at their fourth position are pivotally moved about a center in the proximity of the upper ends 52 of the urging portions in contact with the projections 26 to cause the urging portions 36 to engage the projections 26. As the axis of rotation of the urging portions of the pivoting member moves with its pivotal movement without the axis being fixed at one point, a compact and space-saving pivotal movement can be obtained without any permanent set in fatigue of springs and without any undue increase in locking force. As the urging portions 36 are held at three points by the pressure receiving portions 20, the connection portions 24 and the projections 26, so that the terminal point of a torque to be applied is very clear and the torque or moment can be safely and securely applied to the pressure receiving portions.

(4) According to the invention, the ceiling portion is further provided with a protection wall 17 substantially at its center for preventing the ceiling portion from being raised when the connecting object is accidentally subjected to undue external force. Accordingly, even if the connecting object is accidentally subjected to undue external force, the ceiling portion can be securely prevented from being raised, and the number of conductors can be increased without any defective or failed connection. By partly forming the protection walls 17, the material cost can be reduced.

(5) According to the invention, the contacts 14 and the contacts 14 of the one kind are each provided with an extension portion 44 extending from the fulcrum portion 32 in such a direction that the extension portion faces to the contact portion 22. Consequently, the connecting object such as a flexible printed circuit board can be more securely embraced to obtain the stable connection.

(6) According to the invention, the contacts 141 of the other kind are each provided with an extension portion 44 extending from the fulcrum portion 32 in such a direction that the extension portion faces to the pressure receiving portion 20, and the pivoting member 161 is mounted on the housing 121 so that the urging portions 36 of the pivoting member 161 are pivotally moved between the extension portions 44 and the pressure receiving portions 20. The urging portions 36 of the pivoting member 161 are rotated between the pressure receiving portions 20 and the extensions 44 of the contacts 141 so that the rotation is compact and stable, resulting into a stable connection.

(7) According to the invention, a further contact portion 22 adapted to contact the connecting object is provided on the extension portion 44 of each of the contacts 14 and the contacts of the one kind 14, and a further contact portion 22 adapted to contact the connecting object is also provided between the fulcrum portion 32 and the connection portion 24 of each of the contacts 141 of the other kind. Therefore, the connector can accommodate a connecting object having further contacts provided on its underside, thereby providing a connector having conductors arranged in even more high-density.

(8) According to the invention, the housing 121 is provided with recessed portions 19 on the side of the fitting opening 18 for conducting a connecting object, and the contacts 141 of the other kind are so arranged that the connection portions 24 of the contacts 141 do not extend from the recessed portions 19. Accordingly, the miniaturization of the connector 101 can be achieved, and the connecting object can be easily inserted into the fitting opening 18 by conducting the connecting object in a manner putting or applying it onto the connection portions of the contacts of the other kind.

(9) According to the invention, the connecting object is provided with anchoring portions, and there are provided locking members each having an engaging portion adapted to engage the anchoring portion and the locking means are substantially the same in construction as that of the contacts 14, the contacts 14 of the one kind or the contacts 141 of the other kind. Therefore, even if the connecting object is accidentally subjected to undue external force, it is not removed from the connector while maintaining the advantages of the zero-insertion force (ZIF) construction.

(10) According to the invention, the further contact portion 24 provided on the extension portion 44 of each of the contacts 14 and the contacts 14 of the one kind is constructed to have elasticity, and the further contact portion 24 provided between the fulcrum portion 32 and the connection portion 24 of each of the contacts 141 of the other kind is constructed to have elasticity. Accordingly, the connector can accommodate a connecting object having further contacts provided on its underside, with the result of stable connection.

(11) According to the invention, the housing 12, 121 is provided with anchoring portions 48 at locations corresponding to the connection portions 24 of the contacts 14 or the contacts 14 of the one kind, while the connection portions 24 of the contacts 14 and the contacts 14 of the one kind are each provided with an inclined engaging portion 46 adapted to engage the anchoring portion 48, and the extension portions 44 of the contacts 14 and the contacts 14 of the one kind are not held by the housing 12, 121. Therefore, even lower geometry or reduced overall height of the connector is possible, while the extension portions 44 are prevented from being raised, thereby obtaining stable connection.

(12) According to the invention, in inserting the contact 14 or the contact 14 of the one kind into the housing 12, 121 from the opposite side of the fitting opening 18, at the commencement of the engagement of the anchoring portion 48 with the engaging portion 46, the contact portion 22 of the contact 14 is substantially in parallel with an inserting hole 38 of the housing 12, 121, and on proceeding of the insertion the contact 14 is obliquely inclined so that the contact portion 22 of the contact comes into contact with the upper wall of the inserting hole 38, and when the insertion of the contact has been completed, the contact portion 22 has returned in parallel with the inserting hole 38 with the aid of the inclined engaging portion 46. Consequently, there is no need to hold the extension portions 44 in the housing 12 for preventing the extension portions 44 from rising away from the housing.

(13) When inserting the connecting object such as the flexible printed circuit board 40 into the connector 10 or 101, it can be easily inserted into the fitting opening 18 by conducting the object thereinto in a manner putting or applying it onto the lower surface of the fitting opening 18 of the housing 12 or the connection portions 24 of the contacts 141 of the other kind, without a need to provide a guide in the form of a chamfered or inclined portion at the ceiling of the housing 12 or 121.

(14) According to the invention, the contact portions 22 of the contacts 14, 141 or 142 are brought into contact with the connecting object such as a flexible printed circuit board 40 or flexible flat cable by pivotally moving the pivoting member 16 or 161 on the side of the connection portions 24 of the contacts. Therefore, there is no need to insert a slider into the fitting opening 18 of the housing 12 or 121 so that the lower geometry or reduced overall height of the connector can be achieved by the thickness of the slider.

(15) The further contact portion 22 provided on the extension portion 44 of each of the contacts 14 and the contacts 14 of the one kind and the further contact portion 22 provided between the fulcrum portion 32 and the connection portion 24 of each of the contacts 141 of the other kind are of a bent shape to extend into the fitting opening 18 and have elasticity. Therefore, the connector can accommodate a connecting object having further contacts provided on its underside, thereby providing a connector having conductors arranged in even more high-density and at the same time achieving stable electrical connection owing to the further contact portions 22 of the contacts easy to be worked.

(16) The further contact portions 22 is each provided at a tip with a protrusion, thereby enhancing the stable electrical connection.

DESCRIPTION OF THE REFERENCE NUMERALS

Figure 1A:
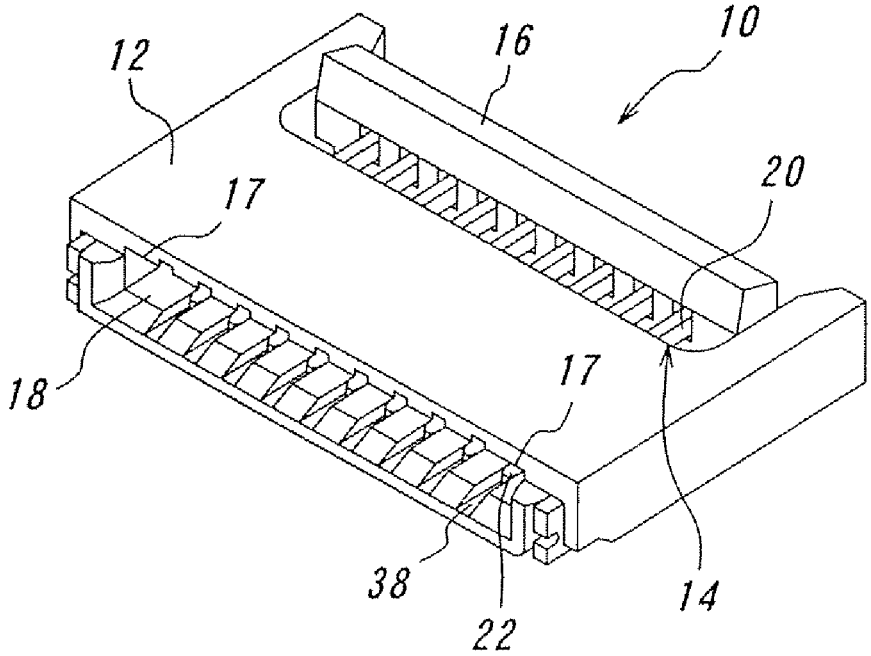
FIG. 1A is a perspective view of a connector according to the invention with a pivoting member opened, viewed from the fitting opening side.

10, 101, 60 Connector
12, 121, 62 Housing
14, 141, 142, 64 Contact
16, 161 Pivoting member
17 Protection wall
18 Fitting opening
19 Recessed portion
20 Pressure receiving portion
22 Contact portion
24 Connection portion
26 Projection
28 Axle
30 Anchoring groove
32 Fulcrum portion
34 Elastic portion
36, 68 Urging portion
38 Inserting hole
40 Flexible printed circuit board
42 Fixed portion
44 Extension portion
46 Engaging portion
48 Anchoring portion
50 Rotational axis
52 Upper end
54 Lower end
66 Slider
70 Receiving portion
72 Slit
74 Mounting portion
76 Fixture

BEST MODE FOR CARRYING OUT THE INVENTION

Figure 1B:
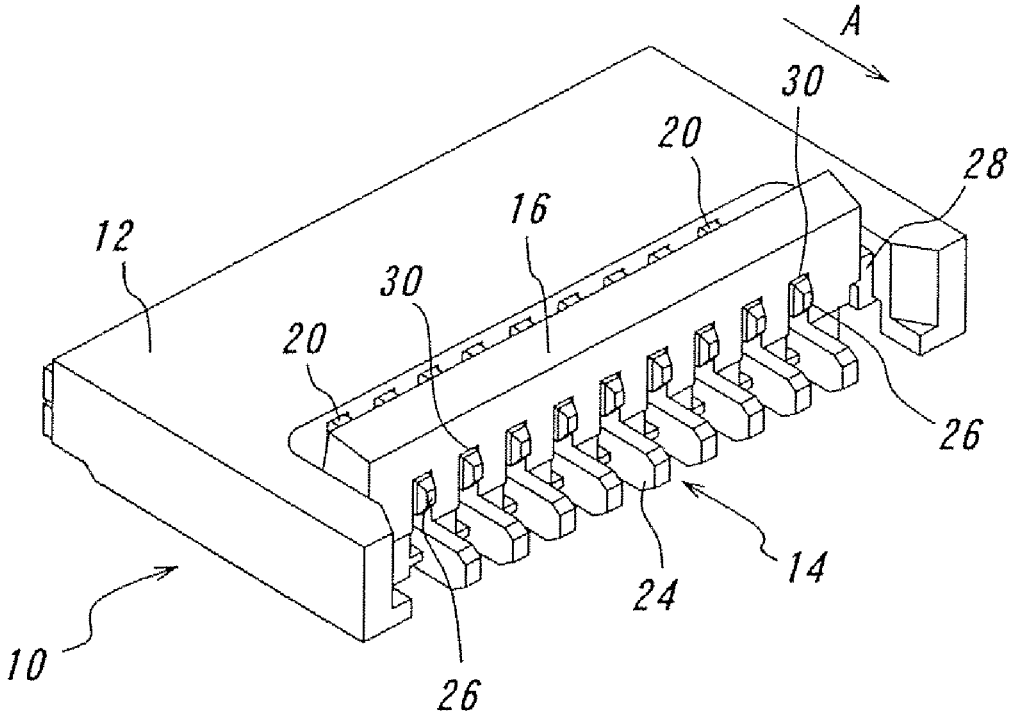
FIG. 1B is a perspective view similar to FIG. 1A viewed from the connection portion side.
Figure 2A:
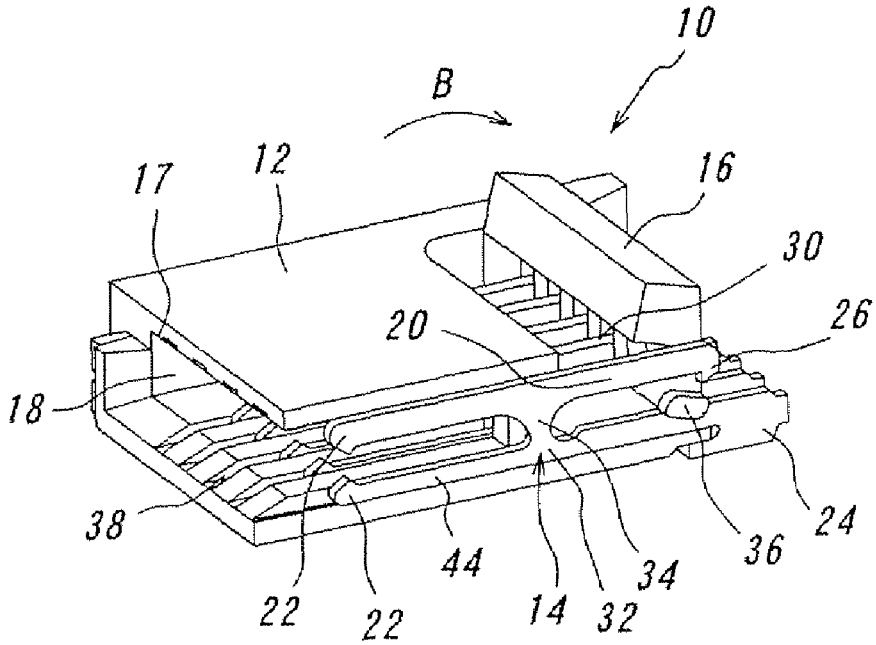
FIG. 2A is a sectional perspective view of a connector according to the invention taken along one contact, with the pivoting member opened.
Figure 2B:
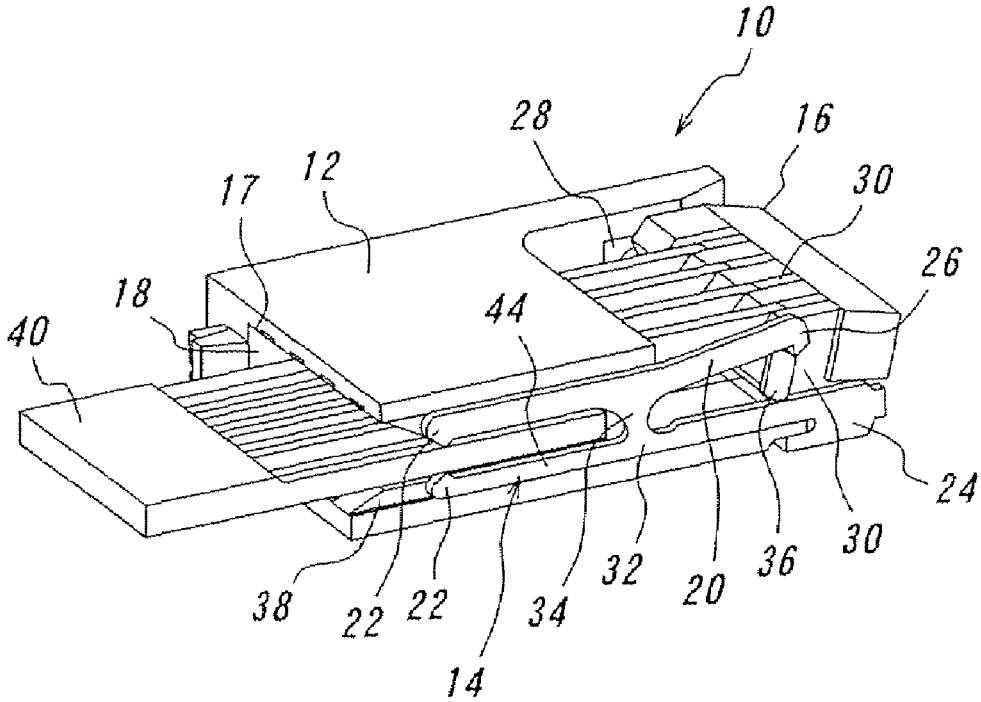
FIG. 2B is a sectional perspective view of the connector taken along one contact, with the pivoting member closed after the flexible printed circuit board has been inserted.
Figure 3:
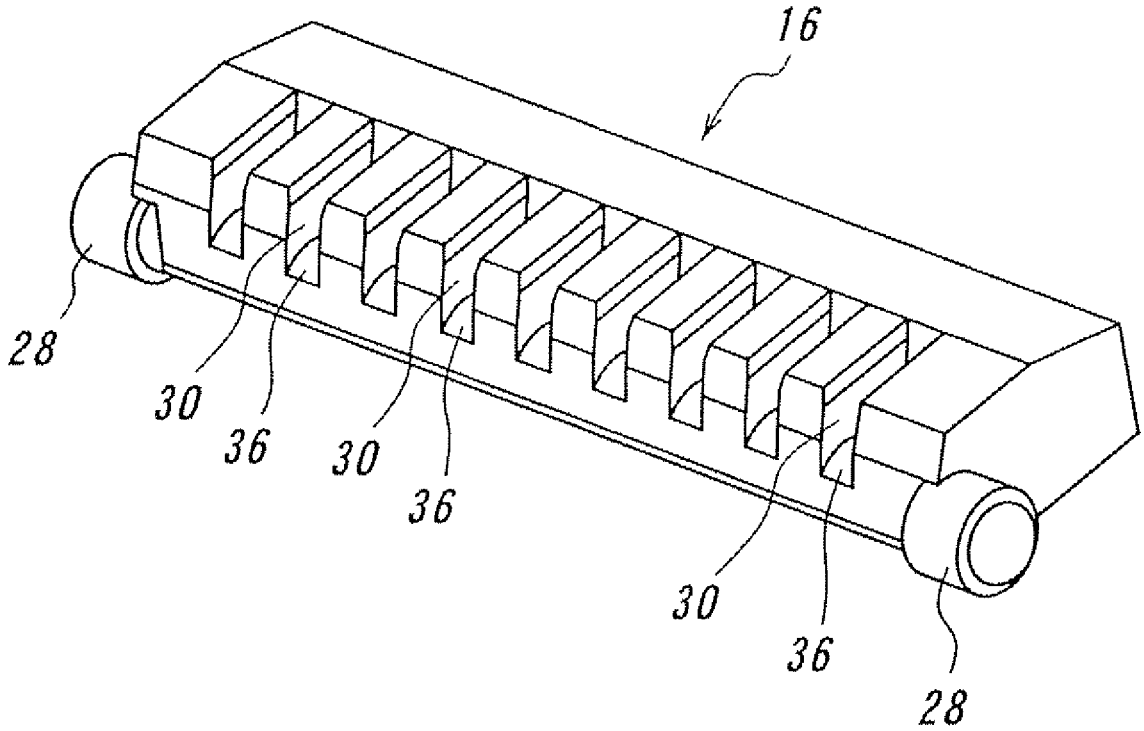
FIG. 3 is a perspective view of the pivoting member.
Figure 4A:
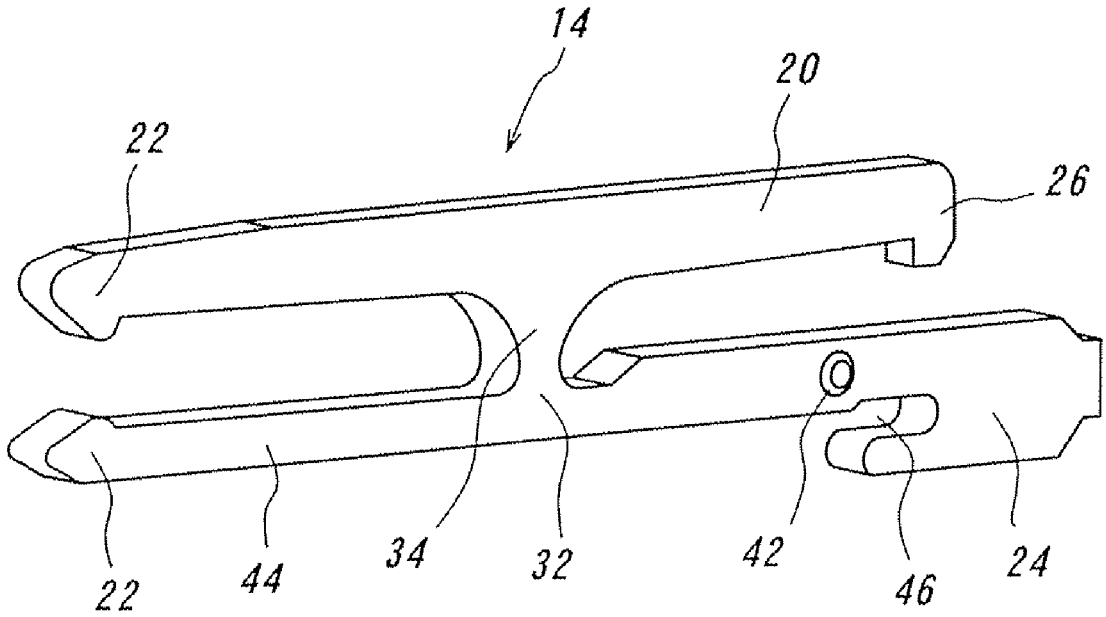
FIG. 4A is a perspective view of a contact having two contact portions.
Figure 4B:
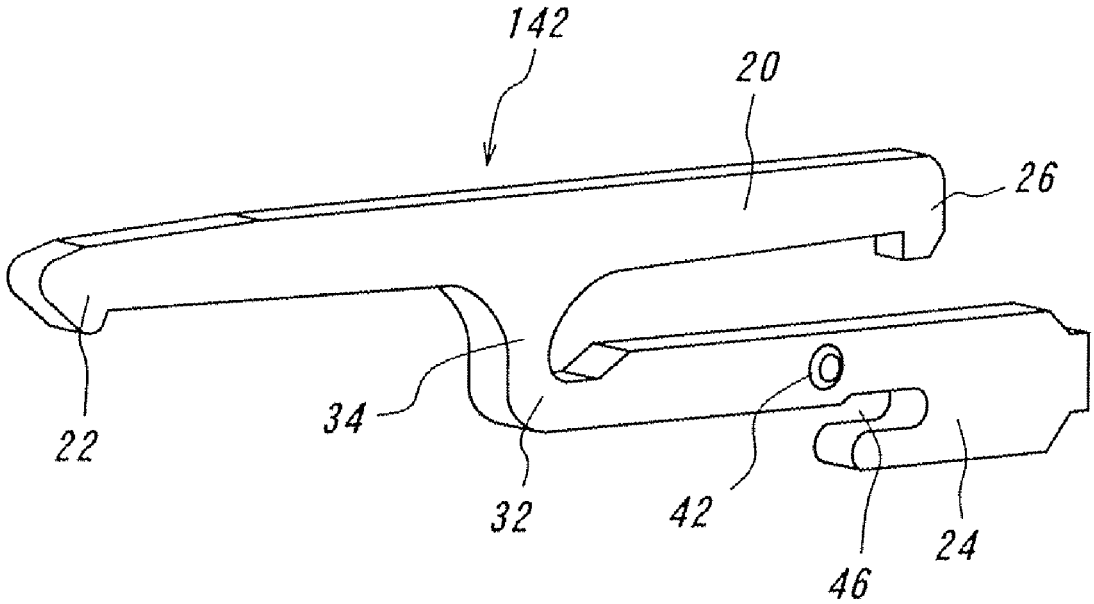
FIG. 4B is a perspective view of a contact having one contact portion.

One embodiment of the connector according to the invention will be explained with reference to FIGS. 1A to 6D. FIG. 1A is a perspective view of the connector according to the invention with a pivoting member opened viewed from the fitting opening side, and FIG. 1B is the connector shown in FIG. 1A viewed from the connection portion side. FIG. 2A is a sectional perspective view of a connector according to the invention taken along one contact, with the pivoting member opened, and FIG. 2B is a sectional perspective view of the connector according to the invention, taken along one contact, with the pivoting member closed after a flexible printed circuit board being inserted. FIG. 3 is a perspective view of the pivoting member. FIG. 4A is a perspective view of a contact having two contact portions, and FIG. 4B is a perspective view of another contact having one contact portion. FIGS. 5A to 5E are views for explaining movements of the urging portion and the rotational axis when the pivoting member is pivotally moved. FIGS. 6A to 6D are views for explaining the mounting of the contacts in the housing.

The connector according to the invention mainly comprises a housing, a pivoting member and contacts.

The components of the connector according to the invention will be explained. First, the contacts will be explained. The contacts are made of a metal and formed by the press-working in the conventional manner. Preferred materials from which to form the contacts include brass, beryllium copper, phosphor bronze and the like to fulfil the requirement imposed thereon, such as springiness, conductivity and the like.

As shown in FIG. 4A, the contact 14 is substantially "H-shaped" and mainly comprises a first piece including a contact portion 22 on its one end adapted to contact a connecting object, a pressure receiving portion 20 on the other end adapted to be urged by the pivoting member 16, and a projection 26 inwardly extending from the front end of the pressure receiving portion 20; a second piece including a fulcrum portion 32 substantially at its center, an extension portion 44 extending from the fulcrum portion 32 to a position opposite or facing to the contact portion 22 of the first piece, a connection portion 24 adapted to be connected to a board or substrate on the other end of the second piece, and a further contact portion 22 at the front end of the extension portion 44; an elastic portion 34 for connecting the first piece and the fulcrum portion 32 of the second piece; and a fixed portion 42 in the proximity of the connection portion 24. The upper contact portion 22 of the first piece, the elastic portion 34, the fulcrum portion 32 and the connection portion 24 are arranged in the form of a crank.

The contact portions 22 are each formed as a protrusion to facilitate the contacting with the connecting object such as the flexible circuited board 40 or flexible flat cable. Although the connection portions 24 are shown of a surface mounting type (SMT) in the embodiment shown in FIG. 1B, it will be apparent that they may be of a dip type. In the illustrated embodiment, there are provided two contact portions 22 to embrace therebetween a flexible printed circuit board 40 or flexible flat cable. By providing the two contact portions 22 on both sides of the insertion direction of the flexible printed circuit board 40 or flexible flat cable, the circuit board or flat cable is embraced by the two contact portions 22 to ensure the reliable connection therebetween.

The fulcrum portion 32, the elastic portion 34 and the pressure receiving portion 20 function as follows when the connecting object such as the board 40 or cable has been inserted into the connector. After the connecting object such as the board 40 or cable has been inserted into a fitting opening 18 of the housing 12, the pivoting member 16 is pivotally moved to pivotally move its urging portions 36 in the space between the connection portions 24 and the pressure receiving portions 20 of the contacts 14 so that the pressure receiving portions 20 are urged upward by the urging portions 36, as a result of which the elastic portions 34 of the contacts 14 are tilted or inclined about their fulcrums portions 32 toward the contact portions 22 to force their upper contact portions 22 against the connecting object such as the flexible printed circuit board or flat cable. The fulcrum portion 32, the elastic portion 34 and the pressure receiving portion 20 are suitably designed particularly on their sizes and shapes to achieve these functions.

It is preferably to provide a projection 26 at the free end of the pressure receiving portion 20 of the contact 14 to prevent the pivoting member 16 from being deformed at its center in the direction shown by an arrow B in FIG. 2A due to strong reaction against the pivotal movement of the pivoting member 16 when causing its urging portions 36 to pivotally move between the connection portions 24 and the pressure receiving portions 20 of the contacts 14. The projection 26 may be formed in any size so long as it can perform its function and may be so designed that the urging portion 36 of the pivoting member 16 securely engages the projection 26.

Moreover, when the pivotal movement of the pivoting member 16 has been completed and the contacts 14 are in contact with the connecting object, the projections 26 function to prevent the urging portions 36 of the pivoting member 16 from being tilted.

The connection portion 24 of the contact 14 is provided with a slightly inclined engaging portion 46 adapted to engage an anchoring portion 48 of the housing 12. The engaging portion 46 serves as a guide when the contact 14 is mounted in the housing 12 and further serves to prevent the lower contact portion 22 provided on the lower portion of the contact 14 from moving away from the connecting object even if the front end of the contact portion 22 of the second piece of the contact is not held, thereby contributing to the lower geometry or reduced overall height. The shape and size of the engaging portion 46 may be suitably designed so as to perform the functions described below. In the illustrated embodiment, the engaging portion 46 is a slightly inclined notch as shown in FIGS. 6A and 0.08 mm.

Movements of the contacts 14 when they are mounted in the housing 12 will be explained by referring to FIGS. 6A to 6D.

Figure 6A:
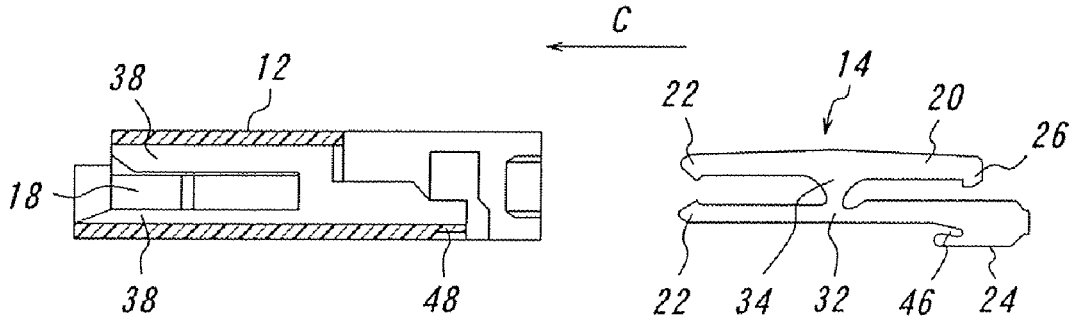
FIGS. 6A to 6D are explanatory views for mounting the contacts into the housing.

As shown in FIG. 6A, the contact 14 is inserted into the housing 12 in the direction shown by an arrow C from the opposite side of the fitting opening 18.

Figure 6B:
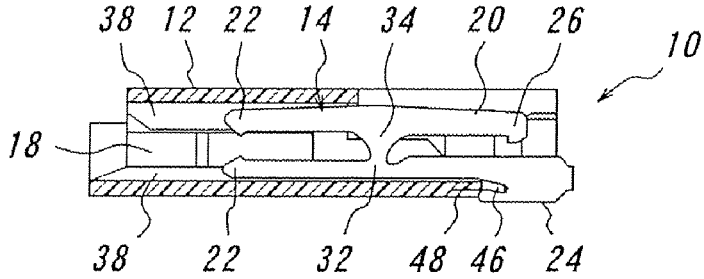

As shown in FIG. 6B, at the commencement of the engagement of the anchoring portion 48 of the housing 12 with the oblique engaging portion 46 of the contact 14, the contact portion 22 of the contact 14 is substantially in parallel with an inserting hole 38 of the housing 12.

Figure 6C:
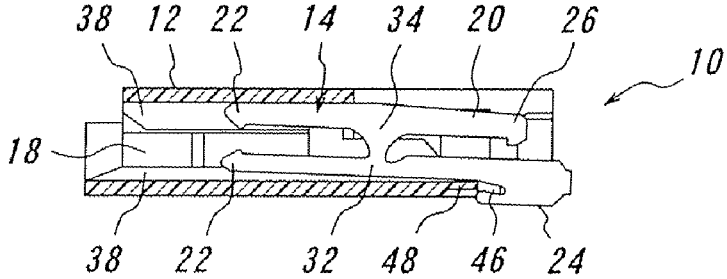

As shown in FIG. 6C, when the contact 14 is further inserted into the housing 12, the contact will be tilted or inclined by clearances between the contact 14 and the inserting hole 38 of the housing 12 so that the upper contact portion 22 of the contact 14 comes into contact with the upper wall of the inserting hole 38.

Figure 6D:
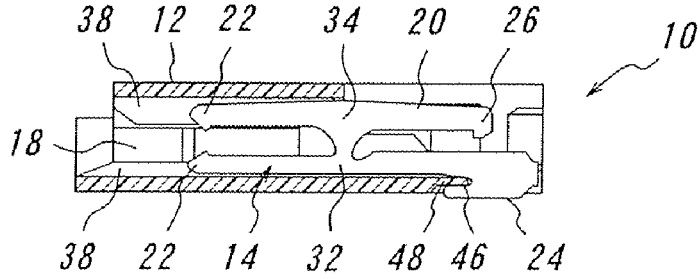

As shown in FIG. 6D, when the insertion of the contact has been completed, the upper contact portion 22 of the contact has returned into parallel with the inserting hole 38 because the contact 14 has been guided by its oblique engaging portion 46.

Another contact will be explained with reference to FIG. 4B. As shown in FIG. 4B, the contact 142 is substantially "h-shaped" and mainly comprises a first peace including a contact portion 22 on its one end adapted to contact a connecting object, a pressure receiving portion 20 on the other end adapted to be urged by the pivoting member 16, and a projection 26 inwardly extending from the front end of the pressure receiving portion 20; a second piece including a fulcrum portion 32 at one end and a connection portion 24 at the other end adapted to be connected to a board or substrate; and an elastic portion 34 for connecting the first piece and the fulcrum portion 32. The contact portion 22, the elastic portion 34, the fulcrum portion 32 and the connection portions 24 are arranged substantially in the form of a crank. In other words, the contact 142 has a configuration that the extension portion 44 extending from the fulcrum portion 32 of the contact 14 and the lower contact portion 22 of the second piece are removed from the contact 14 shown in FIG. 4A. The functions of the contact 142 are substantially the same as those of the contacts 14 described above.

The pivoting member 16 will then be explained. The pivoting member 16 is injection molded from an electrically insulating plastic material in the conventional manner. Preferred materials from which to form the pivoting member 16 include polybutylene terephthalate (PBT), polyamide (66PA or 46PA), liquid crystal polymer (LCP), polycarbonate (PC) and the like and combinations thereof in view of the requirements imposed on the pivoting member 16 such as dimensional stability, workability, manufacturing cost and the like. The pivoting member 16 mainly comprises an actuating portion, axles 28 adapted to be pivotally movably fitted in the housing 12, urging portions 36 for urging the pressure receiving portions 20 of the contacts 14, and anchoring grooves 30 adapted to be engaged with the projections 26 of the contacts 14. The axles 28 are fulcrums for the pivotal movement of the pivoting member 16 and suitably fitted in the housing 12 at locations in the proximity of longitudinal ends of the housing 12 to permit the pivotal movement of the pivoting member 16. The pivoting member 16 is further provided at the longitudinal ends with locking portions adapted to engage the housing 12 for preventing the pivoting member 16 from being lifted (in the upward direction in the drawing) when the pressure receiving portions 20 of the contacts 14 are urged by the urging portions 36 of the pivoting member 16. The locking portions can be in any size and shape so long as they can engage the housing 12 and may be suitably designed in consideration of their function and the size and strength of the connector.

The urging portions 36 serve to urge the pressure receiving portions 20 of the contacts 14 and are preferably of an elongated shape, particularly elliptical in the illustrated embodiment. With such an elliptical shape, when the pivoting member 16 is pivotally moved in the direction shown by the arrow B in FIG. 2A so as to rotate its urging portions in the space between the pressure receiving portions 20 and the connection portions 24 of the contacts 14, the pressure receiving portions 20 of the contacts 14 are moved upwardly with variation in contacting height owing to the elliptical shape of the urging portions 36, resulting in the reliable clamping of contact portions of the connecting object such as the flexible printed circuit board 40 or flat cable against the contact portions 22 of the contacts 14. The urging portions 36 can be formed in any shape insofar as they can rotate between the pressure receiving portions 20 and the connection portions 24 of the contacts 14, and the pressure receiving portions 20 of the contacts 14 can be raised with the aid of the variation in contacting height owing to, for example, difference in major and minor axes of an ellipse.

The pivoting member 16 is further provided with the anchoring grooves 30 independently from each other, which are adapted to engage the projections 26 of the contacts 14 for the purpose of preventing the pivoting member 16 from being deformed at the middle in the direction A in FIG. 1B due to the reaction against the pivotal movement of the pivoting member 16 when being pivotally moved. The independently provided anchoring grooves 30 serve to increase the strength of the slider and to prevent its deformation when being pivotally moved.

Finally, the housing 12 will be explained. The housing is injection molded from an electrically insulating plastic material in the conventional manner. Preferred materials from which to form the housing include polybutylene terephthalate (PBT), polyamide (66PA or 46PA), liquid crystal polymer (LCP), polycarbonate (PC) and the like and combinations thereof in view of the requirements imposed on the housing 16 such as dimensional stability, workability, manufacturing cost and the like.

The housing 12 is formed with inserting grooves or holes 38 in which a required number of contacts 14 or 142 are inserted and fixed thereat by press-fitting, lancing, welding or the like. The housing 12 is further provided in the proximity of the longitudinal ends with holes or bearings for rotatably supporting the axles 28 of the pivoting member 16. The holes or bearings of the housing 12 can be in any shape and size so long as the pivoting member 16 can be rotated and may be suitably designed in consideration of their functions and the strength and size of the housing 12. The housing 12 is further provided at the longitudinal ends with anchoring portions at locations corresponding to the locking portions of the pivoting member 16.

The housing 12 has a ceiling portion covering or insulating the contact portions 22 of the first piece of the contacts 14, and the ceiling portion is formed with protection walls 17 at least on both the ends for preventing the ceiling portion from deforming upwardly when the connecting object is forced upward inadvertently. The term "protection wall" means the wall portion of an edge shape without being chamfered or inclined. In the illustrated embodiment, the protection walls 17 are provided only on both the ends on the ceiling portion of the fitting opening of the connector. By providing the protection walls 17, however, no function and effect for guiding the connecting object such as the flexible printed circuit board 40 are possible.

As a method for guiding the connecting object such as the flexible printed circuit board 40 into the fitting opening 18, the flexible printed circuit board is conducted into the fitting opening in a manner putting or applying it onto the lower face of the fitting opening 18 of the housing 12, thereby easily guiding it into the fitting opening 18.

In order to ascertain the effects of the protection walls, under a condition of the connector with a flexible printed circuit board 40 inserted, the flexible printed circuit board 40 was pulled in a direction perpendicular to the connector in a tension tester (this condition is the same as that the printed circuit board is accidentally forced upwardly when the connector is used in its horizontal position). The results are shown in Table 1 below and a graph of FIG. 13. The "holding force" in the Table 1 and FIG. 13 means the force at a moment when the contacts 14 or 141 are disconnected from the flexible printed circuit board 40, while the flexible printed circuit board 40 is being pulled.

Figure 13:
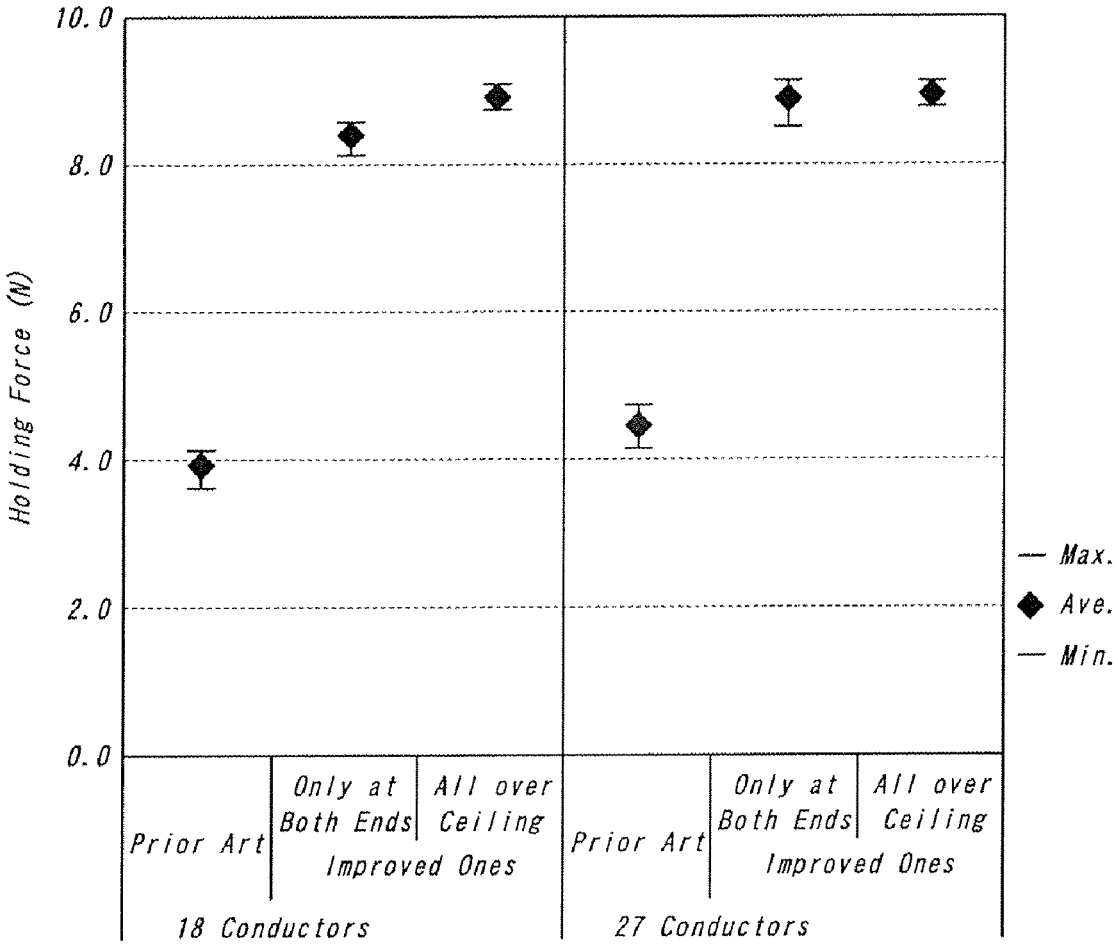
FIG. 13 is a graph illustrating how the holding force is increased by providing the protection walls according to the invention

In the Table 1 and FIG. 13, the prior art connector is the connector having the fitting opening of which ceiling portion is chamfered all over it without any protection wall 17. The improved connector 1 is the connector having the fitting opening of which ceiling portion is provided with protection walls only at both the ends (both the ends are not chamfered). The improved connector 2 is the connector having the fitting opening of which ceiling portion is provided with a protection wall 17 all over it.

TABLE 1

| Number of conductors | | 18 | | | | 27 | | | |
|---|---|---|---|---|---|---|---|---|---|
| Connector No. | | 1 | 2 | 3 | 4 | 1 | 2 | 3 | 4 |
| Prior art connector | | 3.6N | 3.6N | 4.1N | 4.0N | 4.2N | 4.8N | 4.6N | 4.5N |
| Improved connector 2 | Protection wall all over ceiling | 9.1N | 9.1N | 8.8N | 8.9N | 9.1N | 9.0N | 9.0N | 8.9N |
| Improved connector 1 | Protection walls at both ends | 8.6N | 8.2N | 8.4N | 8.5N | 9.2N | 8.8N | 8.6N | 9.1N |
| Mean value of prior art connector | | 3.83N | | | | 4.53N | | | |
| Mean Value | Improved connector 2 | 8.98N | | | | 9.00N | | | |
| | Improved connector 1 | 8.43N | | | | 8.93N | | | |

FIG. 13 graphically illustrates the results of the test.

Referring to the Table 1 and FIG. 13, with respect to the means values, the holding forces (forces at disconnection of the contacts) of the improved connectors 1 (protection walls only at ends) and 2 (protection wall all over the ceiling portion) with 18 conductors increase to 8.4N and 8.9N, respectively, while the holding forces with 27 conductors increase by 8.9N and 9.0N, respectively. Accordingly, with the improved connectors, the holding forces are approximately twice those of the prior art connectors. As can be seen from these results, the holding forces (forces at disconnection of contacts) are remarkably increased by providing the protection wall all over or at both the ends of the inserting opening. In other words, by providing the protection walls the holding forces signifying the stability of contact between the contacts and the connecting object will increase twice when being applied with accidental external forces. This means increased stability for the accidental external forces. It is also apparent that there is no large difference in holding forces between the protection walls provided only at both the ends and all over the ceiling portion of the inserting opening. The improved percentages of holding forces are 220.3% with 18 conductors and 197.2% with 27 conductors. The improved percentage is the value obtained by dividing a holding force for an improved connector by a holding force for a prior art connector. The number of location provided with the protection wall 17 is preferably as few as possible in consideration of the fact that there is no large difference in holding forces between the protection walls 17 provided only at both the ends and provided all over the ceiling portion of the inserting opening, and the prevention of the object such as the flexible printed circuit board 40 from being scratched (damaged). In the illustrated embodiment, the protection walls are provided only both the ends of the ceiling portion of the inserting opening, however, it is preferable to provide the protection walls at three locations, that is, at center and both the ends in view of balancing. In order to prevent the connecting object such as the flexible printed circuit board from being scratched (damaged), it is preferable to design the housing so that it does not contact the connecting object when the connecting object is accidentally subjected to an external force. For this purpose, it is considered to provide a chamfered portion, round chamfer, recessed chamfer or stepped recess. To provide the chamfered portion is preferable in consideration of esthetical quality, material cost and the like.

With respect to the conducting the connecting object into the fitting opening 18, employing the methods described above or below, it is possible to conduct it sufficiently without chamfering the ceiling portion of the fitting opening.

The movement and pivotal movement of the urging portions 36 of the pivoting member 16 will then be explained by referring to FIGS. 5A to 5E. By way of example, the pivotal movement of the contact 141 described later will be explained. However, following explanation will be described to be applicable to the "H-shaped", "h-shaped" contacts or other contact whose connection portion is on the side of the fitting opening of the connector.

Figure 5A:
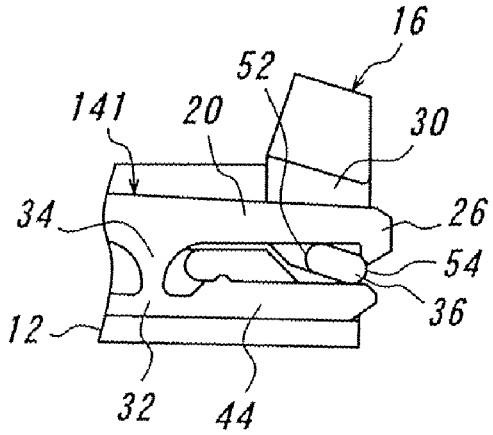
FIGS. 5A to 5E are explanatory views for explaining movements of the urging portions and their center of rotation with the pivotal movement of the pivoting member.

FIG. 5A illustrates the state that the connecting object is not inserted into the connector. The lower end 54 (the right end viewed in the drawing) of the urging portion 36 is positioned between the projection 26 of the pressure receiving portion 20 and the connection portion 24 or extension portion 44 or housing 12 (in the case of no extension portion 44).

Figure 5B:
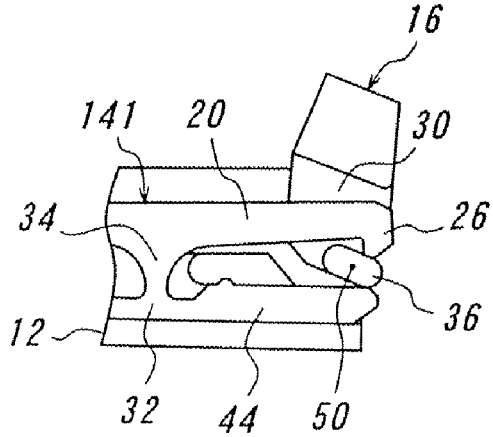

As shown in FIG. 5B, when the actuating portion of the pivoting member is pivotally moved (in the clockwise direction as viewed in the drawing), the urging portion 36 is moved in a direction opposite to the fitting opening 18 of the connector so that the lower end 54 of the urging portion 36 is embraced between the projection of the pressure receiving portion 20 and the connection portion 24 and housing 12 or extension portion 44.

Figure 5C:
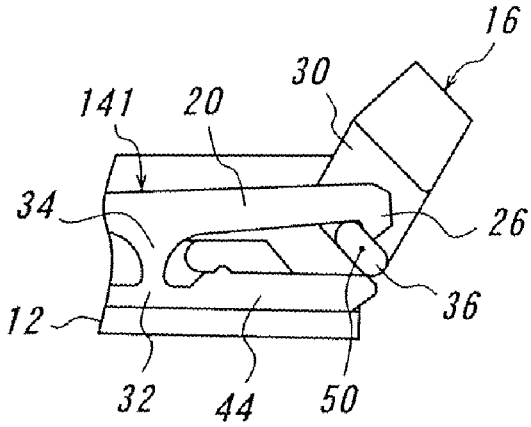

As shown in FIG. 5C, when the actuating portion is further pivotally moved, the urging portion 36 at its position in FIG. 5B is pivotally moved about the center of the urging portion 36 as the rotational axis 50.

Figure 5D:
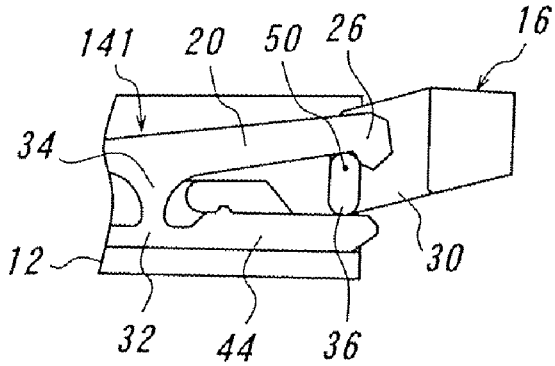

As shown in FIG. 5D, when the actuating portion is further pivotally moved, the urging portion 36 at its position in FIG. 5C is pivotally moved about the center of the urging portion 36 as the rotational axis 50 so that the urging portion 36 stands substantially upright between the pressure receiving portion 20 and the connection portion 24 or housing 12 or extension portion 44, and the rotational axis 50 is moved toward the upper end 52 in contact with the projection 26.

Figure 5E:
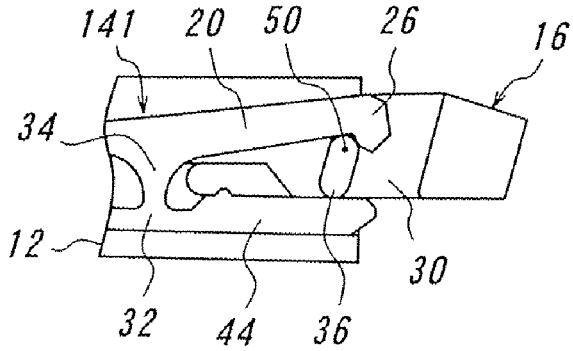

As shown in FIG. 5E, when the actuating portion is further pivotally moved, the urging portion 36 at its position in FIG. 5D is pivotally moved about a center in the proximity of the upper end 52 in contact with the projection 26 so that the urging portion 36 engages the projection 26 in a manner the urging portion 36 catches the projection 26.

In other words, the urging portion 36 is initially moved and then pivotally moved, and when the urging portion 36 is further pivotally moved, the rotational axis 50 progressively changes so that the urging portion 36 performs the compact and space saving pivotal movement or rotation.

In the connector 10, 101 according to the invention, namely, first, when a connecting object such as the flexible printed circuit board 40 is inserted into the fitting opening 18 of the connector, a large force is not required because of the so-called "zero-insertion force" type. Then, the urging portion 36 of the pivoting member 16, 161 is pivotally moved at a location on the side of the projection 26 of the contact 14, 141 (to urge the pressure receiving portion 20 of the contact 14, 141 upwardly at a location closer to the projection 26) so that the pivoting member can be locked with a small force. Moreover, the pressure receiving portion of the contact 14, 141 is urged upwardly on the side of the projection 26 by the urging portion 36 of the pivoting member 16, 161 so that higher contact force can be obtained between the contact and the connecting object.

The other embodiments of the invention will be explained with reference to FIGS. 7A to 10D. The main components of the connector in these embodiments are substantially similar to those of the connector described above, and the connector 101 of these embodiments mainly comprises a housing, contacts and a pivoting member. The subject matter of the connector of these embodiments lies in the fact that the two kinds of the contacts 14 and 141 are arranged to be alternately staggered by inserting the contacts into the housing in opposite directions alternately, thereby achieving narrower pitches of the contacts and lower geometry or reduced overall height of the connector. The pivoting member 161 and the contacts 14 will not be described in further detail since these members are substantially similar to the corresponding members of the connector described above.

Figure 7A:
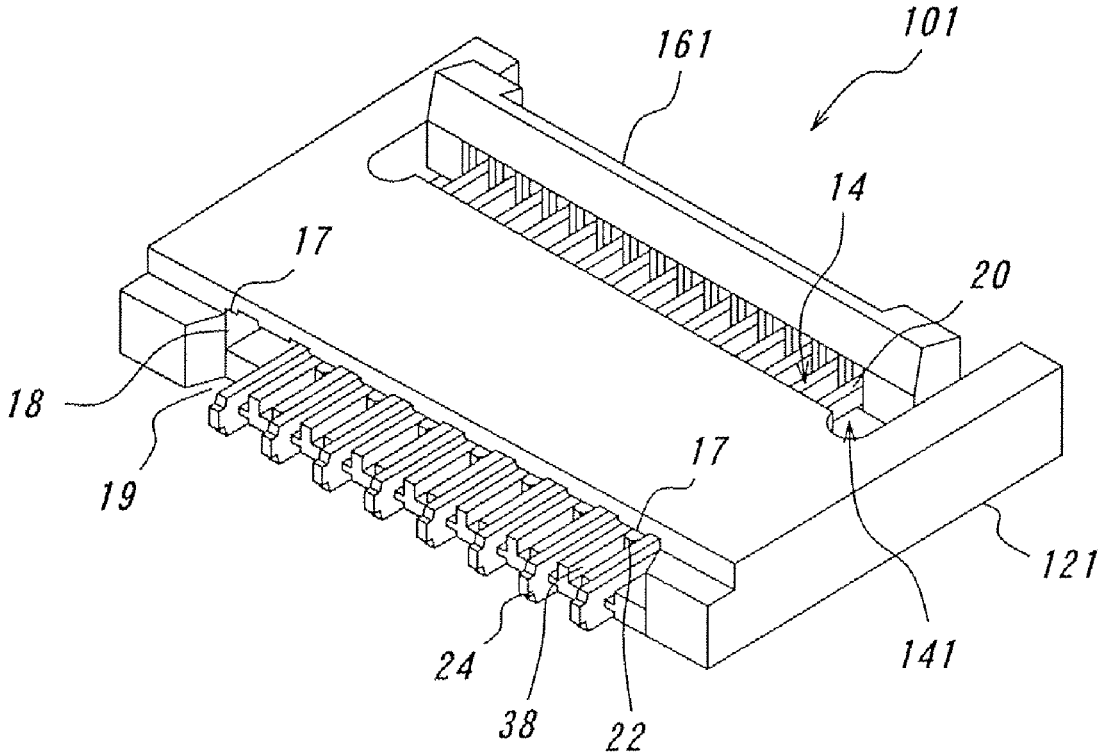
FIG. 7A is a perspective view of another connector according to the invention having contacts of two kinds arranged alternately staggered, with the pivoting member opened, viewed from the fitting opening side.
Figure 7B:
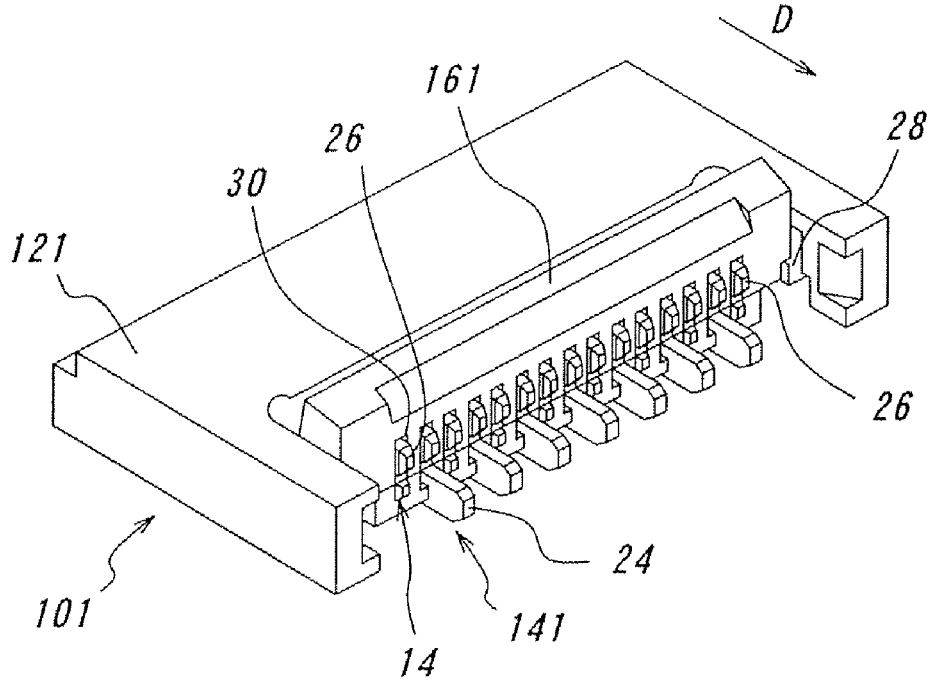
FIG. 7B is a perspective view similar to FIG. 7A viewed from the connection portion side.
Figure 8A:
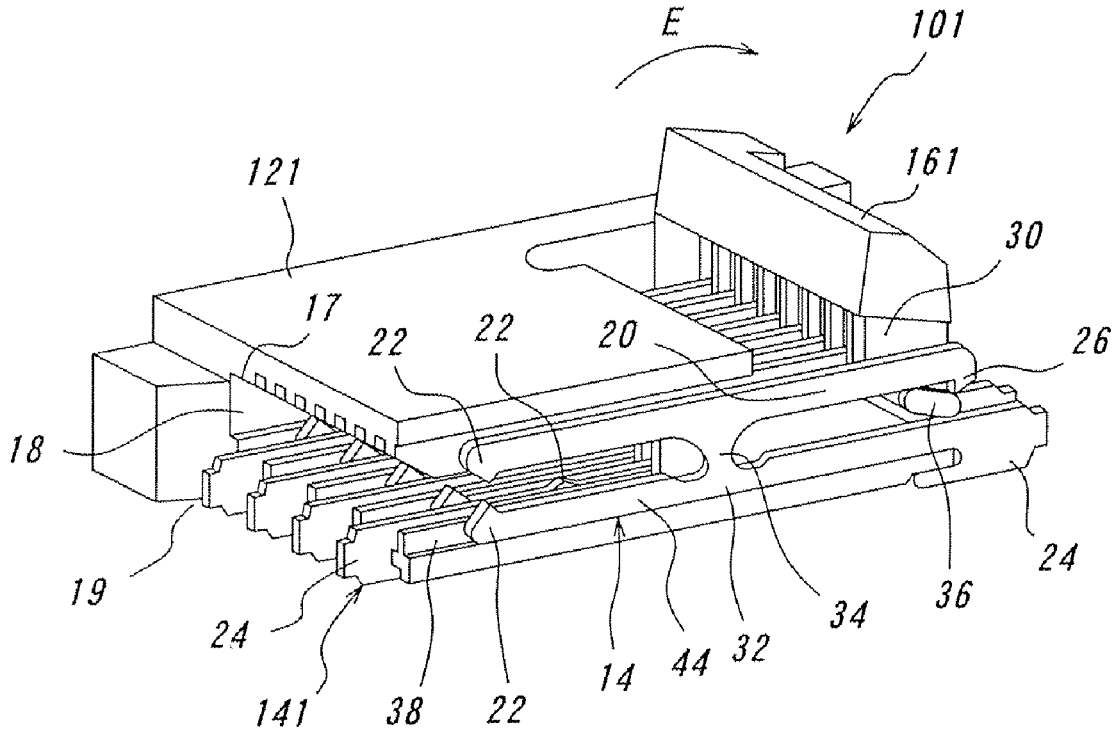
FIG. 8A is a sectional perspective view of a further connector according to the invention having contacts of two kinds arranged alternately staggered, taken along one contact of one kind with the pivoting member opened, viewed from the fitting opening side.
Figure 8B:
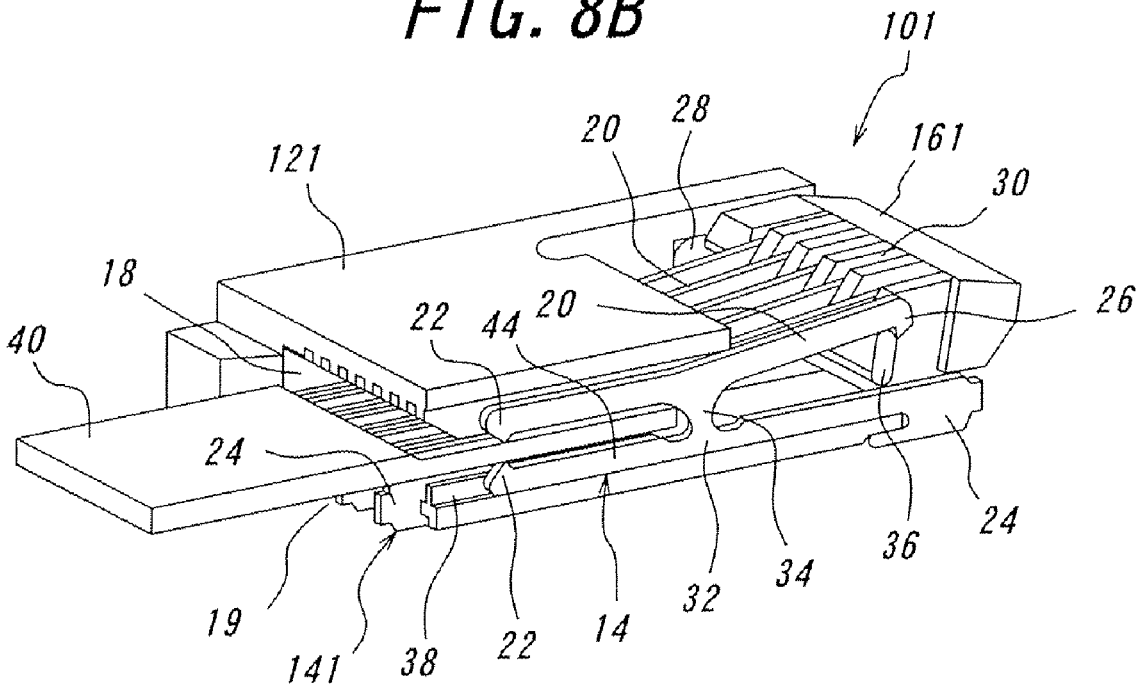
FIG. 8B is a perspective view similar to FIG. 8A with the pivoting member closed after flexible printed circuit board has been inserted.
Figure 9A:
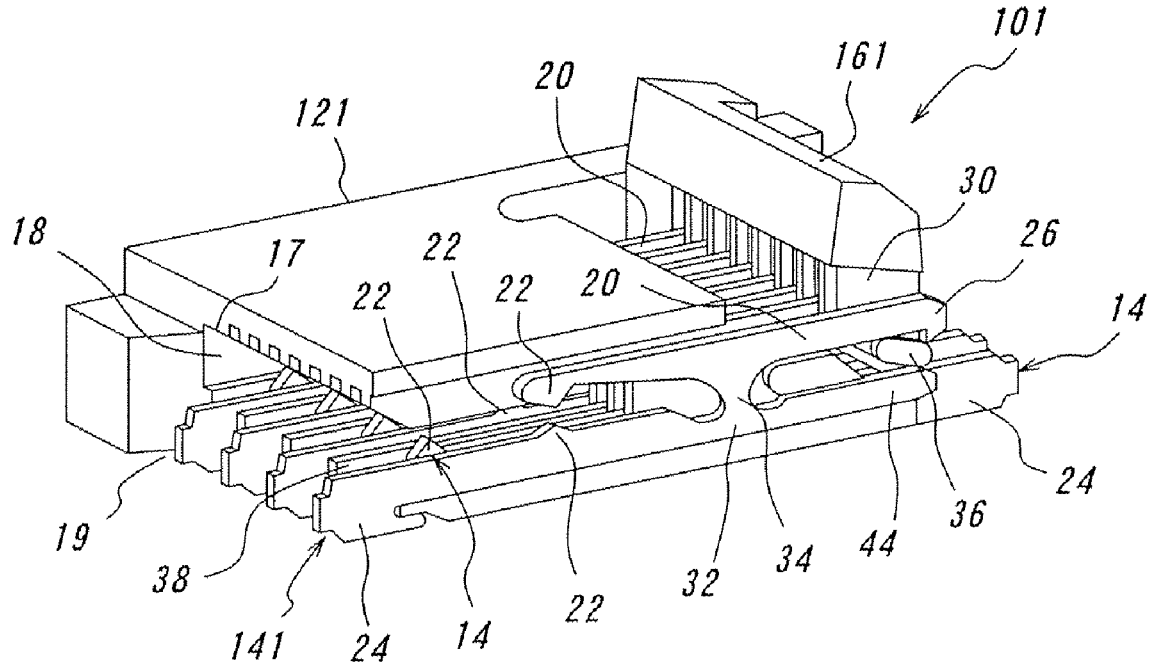
FIG. 9A is a sectional perspective view of a further connector according to the invention having contacts of two kinds arranged alternately staggered, taken along one contact of the other kind with the pivoting member opened, viewed from the fitting opening side.
Figure 9B:
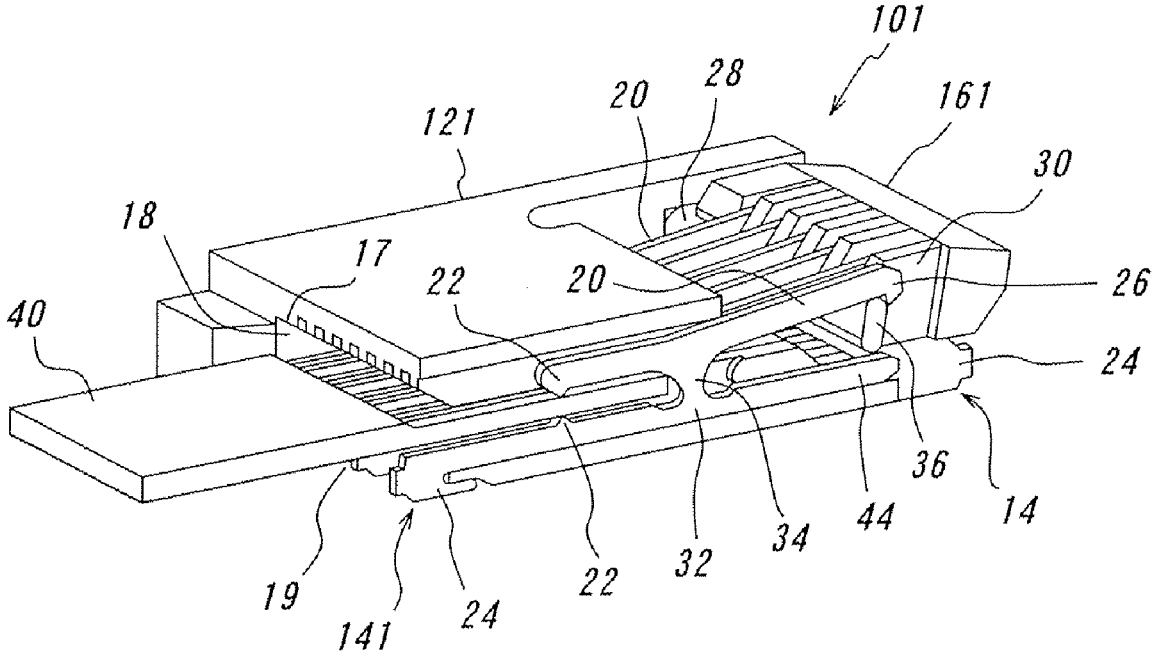
FIG. 9B is a perspective view similar to FIG. 9A with the pivoting member closed after flexible printed circuit board has been inserted.
Figure 10A:
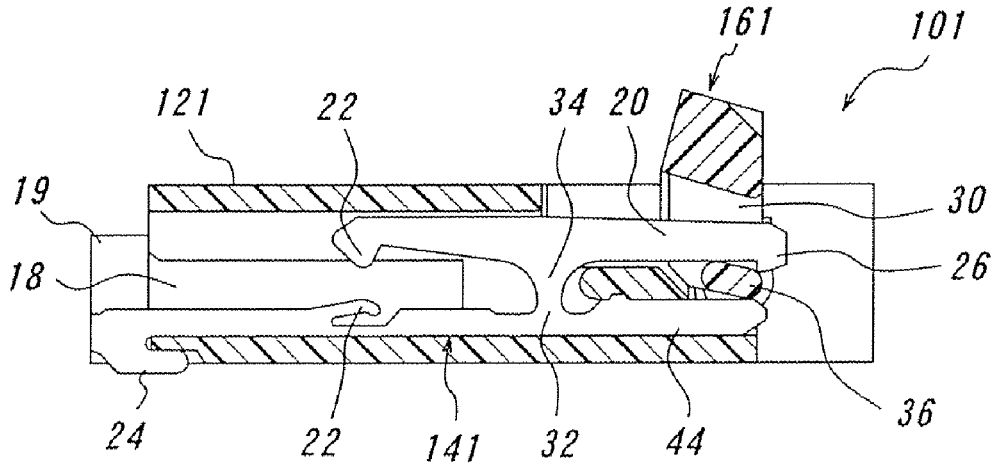
FIG. 10A is a sectional view of a connector according to the invention having contacts whose lower contact portions having elasticity.
Figure 10B:
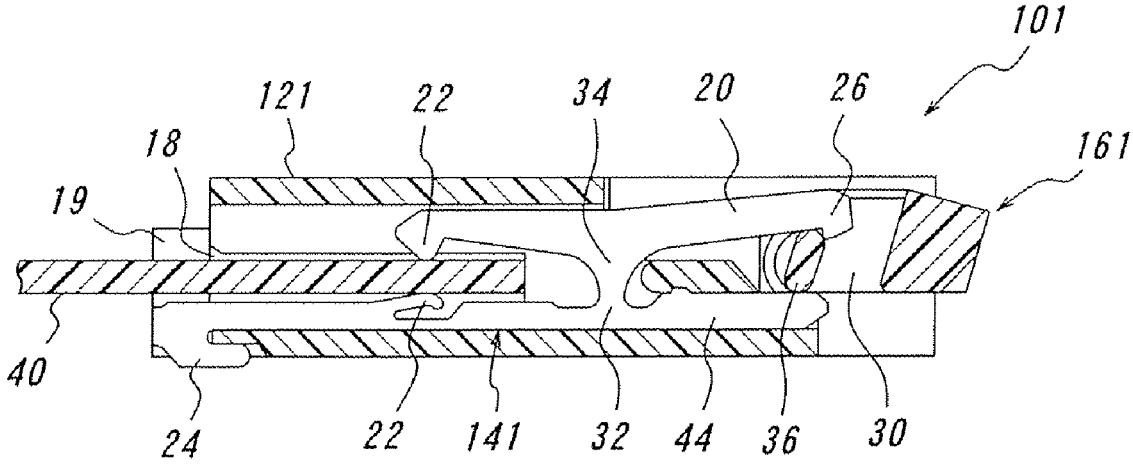
FIG. 10B is a sectional view similar to FIG. 10A after the flexible printed circuit board has been inserted.
Figure 10C:
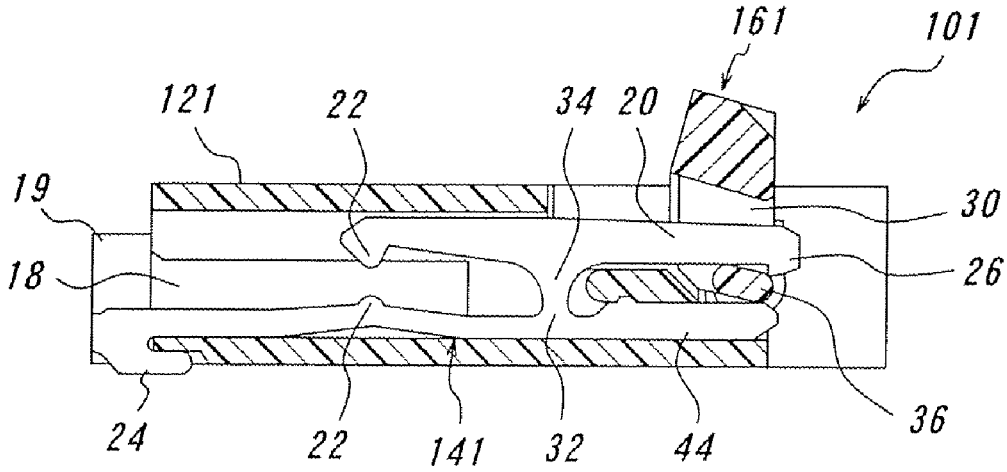
FIG. 10C is a sectional view of another embodiment similar to that shown in FIG. 10A.
Figure 10D:
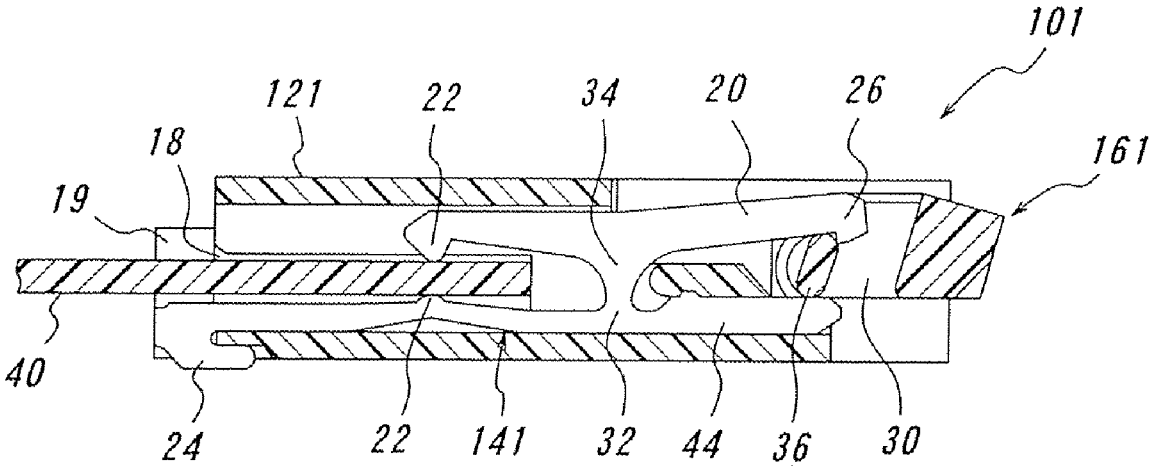
FIG. 10D is the connector shown in FIG. 10C after the flexible printed circuit board has been inserted.

FIG. 7A is a perspective view of the connector of this embodiment of the invention of two kinds of contacts arranged to be alternately staggered with its pivoting member opened viewed from the fitting opening side, while FIG. 7B is a perspective view of the connector in FIG. 7A viewed from the connection portion side. FIG. 8A is a sectional perspective view, taken along one contact, of another connector of two kinds of contacts arranged to be alternately staggered with the pivoting member opened, while FIG. 8B is a sectional perspective view of the connector shown in FIG. 8A with the pivoting member closed after a flexible printed circuit board has been inserted. FIG. 9A is a sectional perspective view, taken along one contact, of a further connector of two kinds of contacts arranged to be alternately staggered with the pivoting member opened, while FIG. 9B is a sectional perspective view of the connector shown in FIG. 9A with the pivoting member closed after a flexible printed circuit board has been inserted. FIG. 10A is a sectional view of a connector whose contacts of the other kind have a lower contact portion having elasticity, while FIG. 10B is a sectional view of the connector shown in FIG. 10A with a flexible printed circuit board inserted. FIG. 10C is a sectional view of another embodiment similar to that shown in FIG. 10A, while FIG. 10D is the connector shown in FIG. 10C after the flexible printed circuit board has been inserted.

The other contacts 141 are also formed by press-working from the metal similar to that of the contacts 14. Likewise, the contacts 141 have two types, substantially "H-shaped" and "h-shaped" in similar to the contacts 14 and 142 shown in FIGS. 4A and 4B.

Referring to FIGS. 9A and 9B, the contact 141 is substantially "H-shaped" and mainly comprises a first piece including a contact portion 22 on its one end adapted to contact a connecting object, a pressure receiving portion 20 on the other end adapted to be urged by the pivoting member 16, and a projection 26 inwardly extending from the front end of the pressure receiving portion 20; a second piece including a connection portion 24 at its one end to be connected to a board or substrate, a fulcrum portion 32, an extension portion 44 extending from the fulcrum portion 32 to a position opposite or facing to the pressure receiving portion 20, and a contact portion 22 in a position opposite or facing to the contact portion 22 of the first piece; an elastic portion 34 for connecting the first piece and the fulcrum portion 32 of the second piece; and a fixed portion 42 (FIG. 4A or 4B) in the proximity of the connection portion 24. The contact portion 22 of the first piece, the elastic portion 34, the fulcrum 32, and the connection portion 24 are arranged substantially in the form of a U-shape.

An "h-shaped" contact (not shown) comprises a first piece including a contact portion 22 at its one end adapted to contact a connecting object, a pressure receiving portion 20 on the other end adapted to be urged by the pivoting member 16, and a projection 26 inwardly extending from the front end of the pressure receiving portion 20; a second piece including a connection portion 24 at its one end adapted to be connected to a board or substrate, a fulcrum portion 32 at the other end, and a contact portion 22 in a position opposite or facing to the contact portion 22 of the first piece; an elastic portion 34 for connecting the first piece and the fulcrum portion 32 of the second piece; and a fixed portion 42 in the proximity of the connection portion 24. The contact portion 22 of the first piece, the elastic portion 34, the fulcrum portion 32, and the connection portion 24 are arranged substantially in the form of a U-shape. In other words, this contact has a configuration that the extension portion 44 extending from the fulcrum 32 of the contact 141 is removed from the contact 141 shown in FIGS. 9A and 9B.

Similarly to the contact 14, the contact portions 22 are each formed as a protrusion at free end to facilitate the contacting with the connecting object such as the circuit board or flat cable. Although the connection portions 24 are shown of a surface mounting type (SMT) in the present embodiment as in FIGS. 8A and 9A, it will be apparent that they may be of a dip type.

Similarly to the contact 14, when the connecting object such as the flexible printed circuit board 40 or flexible flat cable is inserted into the connector and the pivoting member is pivotally moved, the urging portions 36 of the pivoting member 161 are pivotally moved in a space between the pressure receiving portions 20 of the contacts 141 and the housing 121 or between the pressure receiving portions 20 and the extension portions 44 so that the pressure receiving portions 20 are raised by the urging portions 36, with the result that the elastic portions 34 of the contacts 141 are tilted or inclined toward the contact portions 22 about the fulcrum portions 32 of the contacts 141 to urge the contact portions 22 against the connecting object such as the flexible printed circuit board 40 or flexible flat cable. The sizes and shapes of the fulcrum portion 32, the elastic portion 34 and the pressure receiving portion 20 may be suitably designed to achieve their functions.

Moreover, the pressure receiving portions of the contacts are each provided at its front end with the projection 26 to prevent the pivoting member 161 from being deformed at its center in a direction shown by an arrow D in FIG. 7B due to strong reaction against the pivotal movement of the urging portions 36 of the pivoting member 161 in a direction shown by an arrow E in FIG. 8A. It is sufficient to provide the projections 26 only on the contacts 14 of one kind among the two kinds in consideration of the strength of the pivoting member 161 improved by narrower pitches of the contacts. The projections 26 may be in any size so long as their function can be achieved and may be suitably designed to be able to engage the urging portions 36 of the pivoting member 161.

The lower contact portion 22 provided on the lower portion (second piece) of the contact will be explained by referring to FIGS. 10A to 10D. There are sometimes flexible printed circuit boards provided with contacts on the lower surface according to specifications or customers demands. The rigid contacts as shown in FIGS. 9A and 9B are inferior in contact stability. Therefore, it is preferable to provide elasticity to lower contact portions 22 as shown in FIGS. 10A to 10D. For this purpose, a contact portion 22 of contact is formed as a contact piece as shown in FIGS. 10A and 10B. Other than the shape shown in FIGS. 10A and 10B, the lower contact portion 22 may be bent so as to extend into the fitting opening 18 as shown in FIGS. 10C and 10D. Moreover, the contact portion may be further provided with a protrusion at its tip. The shape for this purpose may be any shape insofar as it obtains the elasticity and may be suitably designed in consideration of the miniaturization of the connector 101, contact stability and workability.

The housing 121 will then be explained. The material of the housing 121 is similar to that of the housing 12 and differences from the housing 12 only will be explained herein.

The housing 121 includes a ceiling portion for covering or insulating the contact portions 22 of the first pieces of the contacts 14, 141, and the ceiling portion is provided with at least two protection walls 17 on both the ends for preventing the ceiling portion from being raised when the connecting object such as a flexible printed circuit board is accidentally subjected to external forces. The protection walls are here understood as signifying edges at the front portions of the fitting opening 18 of the connector without being chamfered.

The housing 121 is formed with recessed portions 19 on the side of the fitting opening 18 for conducting or guiding the connecting object such as the flexible circuit board 40 or flat cable into the fitting opening. The size of the recessed portions 19 may be suitably designed so that no contacting portions 24 of the contacts 14, 141 extend from the recessed portion 19 of the housing 12 in consideration of the strength of the housing 12, soldability (connecting capability with solder) of the contacts 14 and 141 and guidance for the flexible printed circuit board 40.

A method for inserting the connecting object such as the flexible printed circuit board 40 into the fitting opening will be explained herein. As the contacts are arranged in the housing 12 such that the connection portions 24 of the contacts 141 of the other kind do not extend from the recessed portions 19, the connecting object is conducted into the fitting opening in a manner putting or applying the connecting object onto the connection portions 24 of the contacts 141, thereby enabling the connecting object to be easily inserted into the fitting opening 18.

Figure 10E:
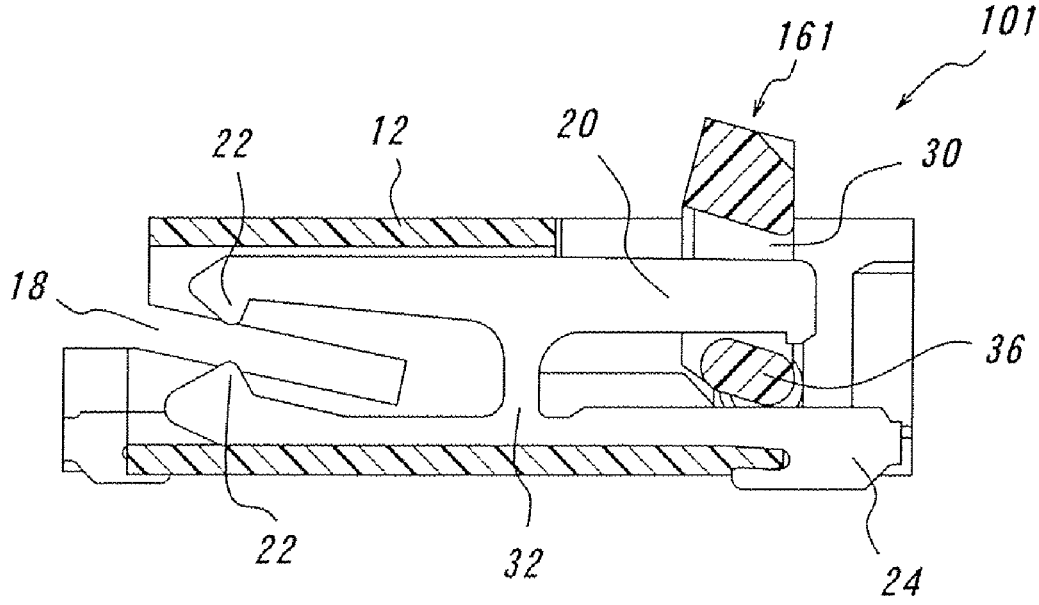
FIG. 10E is a sectional view of still another embodiment similar to FIG. 10A except the insertion opening.
Figure 10F:
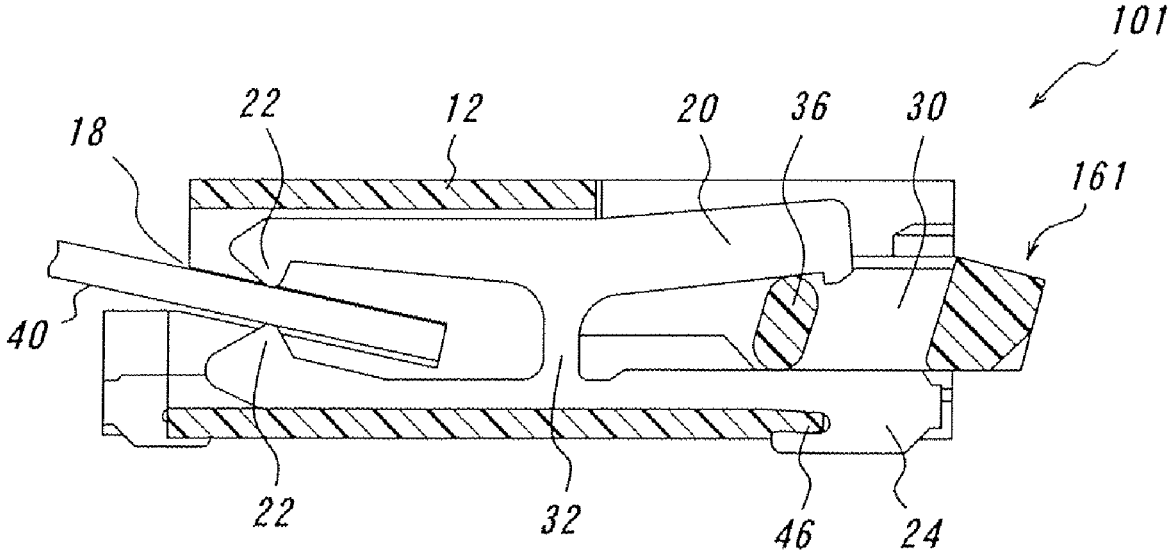
FIG. 10F is the connector shown in FIG. 10E after the flexible printed circuit board has been inserted.
Figure 11:
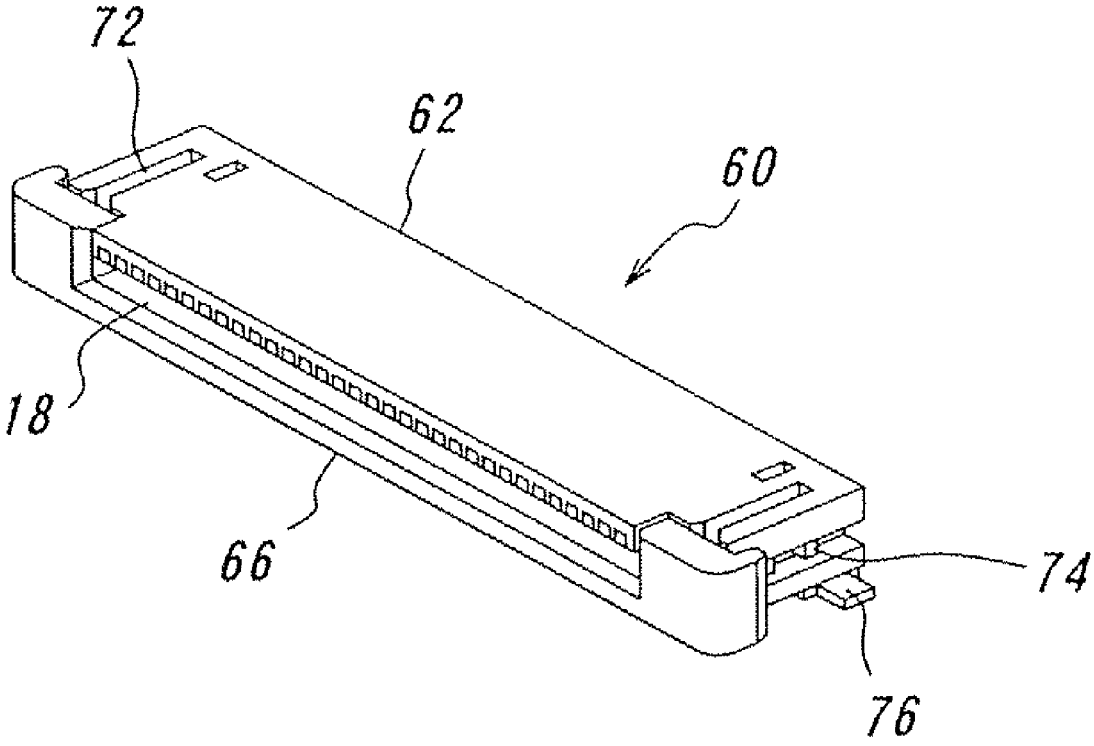
FIG. 11 PRIOR ART
FIG. 11 is a perspective view of the connector of the prior art before inserting a slider, viewed from the fitting opening.
Figure 12A:
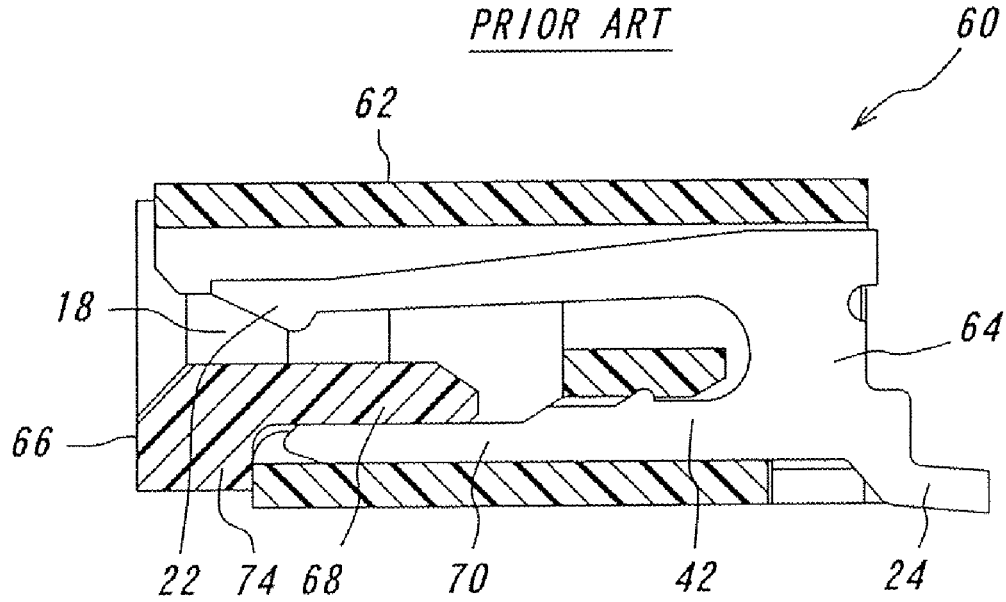
FIG. 12A PRIOR ART
FIG. 12A is a sectional perspective view of the connector of the prior art taken along one contact before inserting the slider.
Figure 12B:
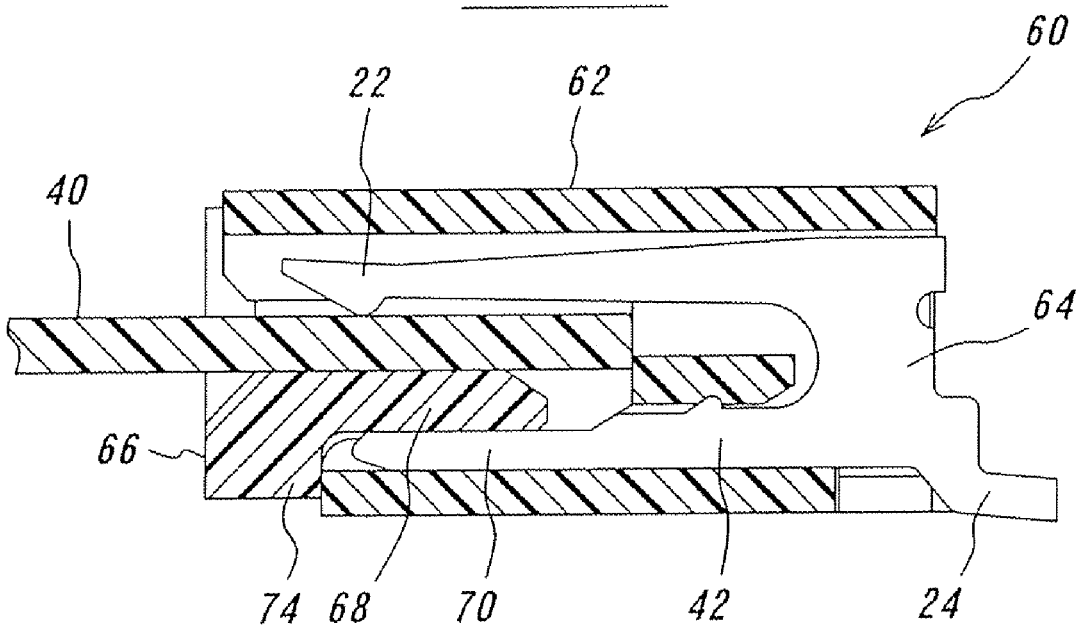
FIG. 12B PRIOR ART
FIG. 12B is a sectional perspective view similar to FIG. 12A after the flexible printed circuit board and the slider have been inserted.

FIGS. 10E and 10F show still further embodiment of the present invention. In this embodiment, the fitting opening 18 is arranged to be inclined as shown in the cross-sectional view. This inclination is to ease the insertion of the connecting object. By experiment, the preferred angle of the inclination from the base plate is between 15 to 25 degree. In a range less than 15 degree, no improvement of ease for insertion is noted and in a range over 25 degree, it is against the object to get less height and moreover, the insertion may become difficult.

Finally, locking members (not shown) will be explained. The locking members are frequently used according to required specification or in a case considering the holding force for the connecting object.

In the case using the locking members, first the connecting object is provided with anchoring portions which may be through-holes, grooves or blind holes. Then the locking members are each provided with an engaging portion adapted to engage the anchoring portion of the connecting object. The construction of the locking members is substantially the same as one of those of the contacts shown in FIGS. 4A and 4B and FIGS. 9A and 9B. With the construction substantially the same as those of these contacts, the locking members can become of "zero-insertion force (ZIF)" type so that even if the connecting object is accidentally subjected to external forces, no disconnections occur and stable connections can be obtained. Namely, in the state that the locking members are in predetermined positions, the pivoting member is pivotally moved to bring the engaging portions of the locking members into engagement with the anchoring portions of the connecting object such as the flexible printed circuit board. The engaging portions are provided at the locations on the locking members corresponding to the upper contact portions 22 of the contacts 14, 141 and 142.

The invention is applicable to connectors for use in mobile phones or cellular phones, notebook personal computers, digital cameras and the like, and more particularly to connectors superior in stable electrical connection with a connecting object such as a flexible printed circuit board or flexible flat cable.

The invention claimed is:

1. A connector including a plurality of contacts having at least one contact portion adapted to contact a connecting object, a housing arranging and holding said contacts and having a fitting opening into which said connecting object is inserted, and a pivoting member for causing said contacts to be elastically deformed to urge said contacts against said connecting object, wherein said contacts each comprise a first piece having the contact portion at one end adapted to contact said connecting object, a pressure receiving portion at the other end adapted to be urged by said pivoting member, and a projection inwardly extending from the front end of said pressure receiving portion; a second piece having a fulcrum portion at one end and a connection portion at the other end adapted to be connected to a board; and an elastic portion for connecting said first piece and said fulcrum portion; and said contact portion, said elastic portion, said fulcrum portion and said connection portion being arranged substantially in the form of a crank, wherein said housing includes a ceiling portion for covering said contact portions of the contacts, said ceiling portion being formed at least on both the ends with protection walls for preventing said ceiling portion from being raised when said connecting object is accidentally subjected to undue external force, and wherein said pivoting member includes an actuating portion for pivotally moving said pivoting member, urging portions continuously arranged in the longitudinal direction of the pivoting member, and anchoring grooves independent from one another for receiving therein said pressure receiving portions and adapted to engage said projections, respectively, and said pivoting member is mounted on said housing so that the urging portions are pivotally moved between the connection portions and the pressure receiving portions of the contacts, and the rotational axis of said urging portions is moved with their pivotal movement to achieve their compact rotation.

2. A connector including a plurality of contacts having at least one contact portion adapted to contact a connecting object, a housing arranging and holding said contacts and having a fitting opening into which said connecting object is inserted, and a pivoting member for causing said contacts to be elastically deformed to urge said contacts against said connecting object, wherein said contacts consist of two kinds of contacts arranged alternately staggered, said contacts of the one kind each comprising a first piece having the contact portion at one end adapted to contact said connecting object and a pressure receiving portion at the other end adapted to be urged by said pivoting member; a second piece having a fulcrum portion at one end and a connection portion at the other end adapted to be connected to a board; and an elastic portion for connecting said first piece and said fulcrum portion; and said contact portion, said elastic portion, said fulcrum portion and said connection portion being arranged substantially in the form of a crank, and said contacts of the other kind each comprising a first piece having the contact portion at one end adapted to contact said connecting object and a pressure receiving portion at the other end adapted to be urged by said pivoting member; a second piece having a connection portion at one end adapted to be connected to a board and a fulcrum portion at the other end; and an elastic portion for connecting said first piece and said fulcrum portion; and said contact portion, said elastic portion, said fulcrum portion and said connection portion being arranged substantially in the form of a U-shape, and said pressure receiving portions of the contacts of at least either the one kind or the other kind being each provided at the front end with an inwardly extending projection, wherein said housing includes a ceiling portion for covering said contact portions of the contacts, said ceiling portion being formed at least on both the ends with protection walls for preventing said ceiling portion from being raised when said connecting object is accidentally subjected to undue external force, and wherein said pivoting member includes an actuating portion for pivotally moving said pivoting member, urging portions continuously arranged in the longitudinal direction of the pivoting member, and anchoring grooves independent from one another for receiving therein said pressure receiving portions and adapted to engage said projections, respectively, and said pivoting member is mounted on said housing so that the urging portions are pivotally moved between the connection portions and the pressure receiving portions of the contacts of the one kind and between the pressure receiving portions of the contacts of the other kind and the housing, and the rotational axis of said urging portions is moved with their pivotal movement to achieve their compact rotation.

3. A connector including a plurality of contacts having at least one contact portion adapted to contact a connecting object, a housing arranging and holding said contacts and having a fitting opening into which said connecting object is inserted, and a pivoting member for causing said contacts to be elastically deformed to urge said contacts against said connecting object, wherein said contacts each comprise a first piece having the contact portion at one end adapted to contact said connecting object, a pressure receiving portion at the other end adapted to be urged by said pivoting member, and a projection inwardly extending from the front end of said pressure receiving portion; a second piece having a fulcrum portion at one end, and a connection portion at the other end adapted to be connected to a board; and an elastic portion for connecting said first piece and said fulcrum portion; and said contact portion, said elastic portion, said fulcrum portion and said connection portion being arranged substantially in the form of a crank, wherein said housing includes a ceiling portion for covering said contact portions of the contacts, said ceiling portion being formed at least on both the ends with protection walls for preventing said ceiling portion from being raised when said connecting object is accidentally subjected to undue external force, wherein said pivoting member includes an actuating portion for pivotally moving said pivoting member, urging portions continuously arranged in the longitudinal direction of the pivoting member, and anchoring grooves independent from one another for receiving therein said pressure receiving portions and adapted to engage said projections, respectively, and wherein said pivoting member is mounted on said housing such that before connecting said connecting object to said connector, the lower ends of said urging portions are positioned between the projections of said pressure receiving portions and said connection portions of said contacts, that second on pivotally moving said actuating portion of the pivoting member, said urging portions are moved in a direction opposite to said fitting opening so that the lower ends of said urging portions are embraced between the projections of said pressure receiving portions and said extension portions of said contacts, that third on further pivotally moving said actuating portion of the pivoting member, said urging portions at their second position are pivotally moved about the center of said urging portions as their rotational axis, that fourth on further pivotally moving said actuating portion of the pivoting member, said urging portions at their third position are pivotally moved about the center of said urging portions as their rotational axis so that said urging portions stand substantially upright between said pressure receiving portions and said connection portions, and the rotational axis is moved toward the upper ends of said urging portions in contact with said projections, and that finally on further pivotally moving said actuating portion of the pivoting member, said urging portions at their fourth position are pivotally moved about a center in the proximity of the upper ends of said urging portions in contact with said projections to cause said urging portions to engage said projections, thereby moving the rotational axis of said urging portions with their pivotal movement to achieve their compact rotation.

4. A connector including a plurality of contacts having at least one contact portion adapted to contact a connecting object, a housing arranging and holding said contacts and having a fitting opening into which said connecting object is inserted, and a pivoting member for causing said contacts to be elastically deformed to urge said contacts against said connecting object, wherein said contacts consist of two kinds of contacts arranged alternately staggered, said contacts of the one kind each comprise a first piece having the contact portion at one end adapted to contact said connecting object and a pressure receiving portion at the other end adapted to be urged by said pivoting member; a second piece having a fulcrum portion at one end, and a connection portion at the other end adapted to be connected to a board; and an elastic portion for connecting said first piece and said fulcrum portion; and said contact portion, said elastic portion, said fulcrum portion and said connection portion being arranged substantially in the form of a crank, and said contacts of the other kind each comprise a first piece having the contact portion at one end adapted to contact said connecting object, and a pressure receiving portion at the other end adapted to be urged by said pivoting member; a second piece having a connection portion at one end adapted to be connected to a board, and a fulcrum portion at the other end; and an elastic portion for connecting said first piece and said fulcrum portion; and said contact portion, said elastic portion, said fulcrum portion and said connection portion being arranged substantially in the form of a U-shape, and said pressure receiving portions of the contacts of at least either the one kind or the other kind being each provided at the front end with an inwardly extending projection, wherein said housing includes a ceiling portion for covering said contact portions of the contacts, said ceiling portion being formed at least on both the ends with protection walls for preventing said ceiling portion from being raised when said connecting object is accidentally subjected to undue external force, wherein said pivoting member includes an actuating portion for pivotally moving said pivoting member, urging portions continuously arranged in the longitudinal direction of the pivoting member, and anchoring grooves independent from one another for receiving therein said pressure receiving portions and adapted to engage said projections, respectively, and wherein said pivoting member is mounted on said housing such that before connecting said connecting object to said connector, the lower ends of said urging portions are positioned between the projections of said pressure receiving portions and the connection portions and the housing and, that second on pivotally moving said actuating portion of the pivoting member, said urging portions are moved in a direction opposite to said fitting opening so that the lower ends of said urging portions are embraced between the projections of said pressure receiving portions and the extension portions of said contact and the housing, that third on further pivotally moving said actuating portion of the pivoting member, said urging portions at their second position are pivotally moved about the center of said urging portions as their rotational axis, that fourth on further pivotally moving said actuating portion of the pivoting member, said urging portions at their third position are pivotally moved about the center of said urging portions as their rotational axis so that said urging portions stand substantially upright between said pressure receiving portions and said connection portions and the housing, and the rotational axis is moved toward the upper ends of said urging portions in contact with said projections, and that finally on further pivotally moving said actuating portion of the pivoting member, said urging portions at their fourth position are pivotally moved about a center in the proximity of the upper ends of said urging portions in contact with said projections to cause said urging portions to engage said projections, thereby moving the rotational axis of said urging portions with their pivotal movement to achieve their compact rotation.

5. The connector as set forth in claim 1, wherein when the connecting object is connected to the connector, the urging portions of the pivoting member are positioned such that before connecting said connecting object to said connector, the lower ends of said urging portions are positioned between the projections of said pressure receiving portions and the connection portions and the housing or extension portions, that second on pivotally moving said actuating portion of the pivoting member, said urging portions are moved in a direction opposite to said fitting opening so that the lower ends of said urging portions are embraced between the projections of said pressure receiving portions and the connection portions and the housing or extension portions, that third on further pivotally moving said actuating portion of the pivoting member, said urging portions at their second position are pivotally moved about the center of said urging portions as their rotational axis, that fourth on further pivotally moving said actuating portion of the pivoting member, said urging portions at their third position are pivotally moved about the center of said urging portions as their rotational axis so that said urging portions stand substantially upright between said pressure receiving portions and said connection portions and the housing or the extension portions, and the rotational axis is moved toward the upper ends of said urging portions in contact with said projections, and that finally on further pivotally moving said actuating portion of the pivoting member, said urging portions at their fourth position are pivotally moved about a center in the proximity of the upper ends of said urging portions in contact with said projections to cause said urging portions to engage said projections.

6. The connector as set forth in any one of claim 1, wherein said ceiling portion is further provided with a protection wall substantially at its center for preventing said ceiling portion from being raised when the connecting object is accidentally subjected to undue external force.

7. The connector as set forth in any one of claim 1, wherein said contacts and said contacts of the one kind are each provided with an extension portion extending from the fulcrum portion in such a direction that said extension portion faces to said contact portion.

8. The connector as set forth in claim 2, wherein said contacts of the other kind are each provided with an extension portion extending from the fulcrum portion in such a direction that said extension portion faces to said pressure receiving portion, and said pivoting member is mounted on the housing so that said urging portions of the pivoting member are pivotally moved between said extension portions and said pressure receiving portions.

9. The connector as set forth in any one of claim 2, wherein a further contact portion adapted to contact the connecting object is provided on said extension portion of each of said contacts and said contacts of the one kind, and a further contact portion adapted to contact the connecting object is also provided between said fulcrum portion and the connection portion of each of said contacts of the other kind.

10. The connector as set forth in any one of claim 2, wherein said housing is provided with recessed portions on the side of the fitting opening for conducting a connecting object, and the contacts of the other kind are so arranged that the connection portions of the contacts do not extend from said recessed portions.

11. The connector as set forth in any one of claim 1, wherein the connecting object is provided with anchoring portions, and there are provided locking members each having an engaging portion adapted to engage said anchoring portion and said locking members are substantially the same in construction as that of said contacts, said contacts of the one kind or said contacts of the other kind.

12. The connector as set forth in claim 9, wherein said further contact portion provided on said extension portion of each of said contacts and said contacts of the one kind is constructed to have elasticity, and said further contact portion provided between the fulcrum portion and the connection portion of each of said contacts of the other kind is constructed to have elasticity.

13. The connector as set forth in claim 11, wherein the housing is provided with anchoring portions at locations corresponding to the connection portions of said contacts or said contacts of the one kind, while the connection portions of said contacts and said contacts of the one kind are each provided with an inclined engaging portion adapted to engage said anchoring portion, and said extension portions of said contacts and said contacts of the one kind are not held by the housing.

14. The connector as set forth in claim 13, wherein when inserting said contact or said contact of the one kind into said housing from the opposite side of said fitting opening, at the commencement of the engagement of the anchoring portion with the engaging portion, the contact portion of the contact is substantially in parallel with an inserting hole of the housing, and on proceeding of the insertion the contact is obliquely inclined so that the contact portion of the contact comes into contact with the upper wall of the inserting hole, and wherein when the insertion of the contact has been completed, the contact portion has returned in parallel with the inserting hole with the aid of said inclined engaging portion.

15. The connector as set forth in claim 9, wherein said further contact portion provided on said extension portion of each of said contacts and said contacts of the one kind and said further contact portion provided between said fulcrum portion and the connection portion of each of said contacts of the other kind are of a bent shape to extend into said fitting opening and have elasticity.

16. The connector as set forth in claim 15, wherein a tip of each of said further contact portions is provided with a protrusion.

17. The connector as set forth in any one of claim 1, wherein the fitting opening is inclined for easy insertion of connecting object.

18. The connector as set forth in claim 17, wherein inclination of the fitting opening is in an angle between 15 to 25 degree with respect to the base of housing of the connector.

* * * * *